US010209663B2

(12) United States Patent
Kanamoto et al.

(10) Patent No.: US 10,209,663 B2
(45) Date of Patent: Feb. 19, 2019

(54) IMAGE FORMING APPARATUS, CONTROL METHOD FOR IMAGE FORMING APPARATUS, AND NON-TRANSITORY COMPUTER-READABLE STORAGE MEDIUM

(71) Applicant: CANON KABUSHIKI KAISHA, Tokyo (JP)

(72) Inventors: Yoshiji Kanamoto, Abiko (JP); Toshihiko Iida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/793,072

(22) Filed: Oct. 25, 2017

(65) Prior Publication Data

US 2018/0126767 A1 May 10, 2018

(30) Foreign Application Priority Data

Nov. 10, 2016 (JP) ..... 2016-219577

(51) Int. Cl.
*B42B 5/08* (2006.01)
*G03G 15/00* (2006.01)
(Continued)

(52) U.S. Cl.
CPC ..... *G03G 15/70* (2013.01); *B26F 1/0092* (2013.01); *B26F 1/02* (2013.01); *B42B 5/08* (2013.01);
(Continued)

(58) Field of Classification Search
CPC ... B42B 5/103; B42B 5/08; B42B 5/10; B26F 1/0092; B26F 1/02; B42C 1/12;
(Continued)

(56) References Cited

U.S. PATENT DOCUMENTS 6,674,976 B2 * 1/2004 Sato ..... B42C 1/12 270/58.09
8,121,497 B2 * 2/2012 Yamada ..... G03G 15/70 399/16
(Continued)

FOREIGN PATENT DOCUMENTS

EP 2937224 A1 10/2015

OTHER PUBLICATIONS

Search Report dated Feb. 27, 2018, in European Patent Application No. 17199122.7.

*Primary Examiner* — Leslie A Nicholson, III
(74) *Attorney, Agent, or Firm* — Venable LLP

(57) ABSTRACT

An image forming apparatus including: a printer; a puncher configured to punch the sheet printed by the printer; a binder configured to perform a bookbinding process to form a bound product in which a binding member penetrates punch holes of sheets; a first detector configured to detect a first jam of a sheet in the binder; a second detector configured to detect a second jam of a sheet which occurs upstream of the binder; an annunciator configured to notify information; and a controller configured to cause the annunciator to notify first instruction information for instructing removal of a sheet and the binding member, when the first detector has detected the first jam; and cause the annunciator to notify second instruction information for instructing removal of the second jam when the second detector has detected the second jam and the first detector has not detected the first jam.

7 Claims, 14 Drawing Sheets

(51) Int. Cl.

| | |
|---|---|
| ***B26F 1/00*** | (2006.01) |
| ***B26F 1/02*** | (2006.01) |
| ***B42B 5/10*** | (2006.01) |
| ***B42C 1/12*** | (2006.01) |
| ***B42B 5/12*** | (2006.01) |

(52) U.S. Cl.
CPC ..... *B42B 5/103* (2013.01); *B42B 5/106* (2013.01); *B42B 5/126* (2013.01); *B42C 1/12* (2013.01); *G03G 15/6544* (2013.01); *G03G 15/6582* (2013.01); *B65H 2511/528* (2013.01); *B65H 2601/11* (2013.01); *B65H 2601/255* (2013.01); *G03G 2215/00818* (2013.01); *G03G 2215/00936* (2013.01)

(58) Field of Classification Search
CPC ..... B65H 2511/528; B65H 2601/11; B65H 2601/255; G03G 15/6544; G03G 2215/00818; G03G 2215/00936
USPC ..... 270/58.07, 58.08, 58.09; 412/38, 42
See application file for complete search history.

(56) References Cited

U.S. PATENT DOCUMENTS

| | | | | |
|---|---|---|---|---|
| 8,141,862 | B2 * | 3/2012 | Motoyoshi ..... | B65H 37/04 270/58.02 |
| 8,690,145 | B2 | 4/2014 | Togawa | |
| 9,598,252 | B1 * | 3/2017 | Middleton ..... | B65H 5/062 |
| 2015/0168906 | A1 * | 6/2015 | Ishii ..... | G03G 15/70 399/21 |
| 2015/0298486 | A1 | 10/2015 | Miyata et al. | |
| 2018/0208420 | A1 * | 7/2018 | Link ..... | B65H 7/06 |

* cited by examiner

PF
501
502
503
505

501
502
503
506

505

506
516

507
517

508
509

510
504
511
512
513
514
417
707
708

IMAGE FORMING APPARATUS, CONTROL METHOD FOR IMAGE FORMING APPARATUS, AND NON-TRANSITORY COMPUTER-READABLE STORAGE MEDIUM

BACKGROUND OF THE INVENTION

Field of the Invention

The present invention relates to an image forming apparatus, a control method for an image forming apparatus, and a non-transitory computer-readable storage medium.

Description of the Related Art

Hitherto, as one of post-processing functions that can be executed by a post-processing apparatus configured to perform a post-process on sheets discharged from an image forming apparatus, there has been known a function of aligning a plurality of printed sheets and performing processing, for example, binding, of those plurality of printed sheets (U.S. Pat. No. 8,690,145). As one example of the function, there is given a ring bookbinding process for obtaining a bookbinding printed product by performing a punching process on an end portion of the sheets, inserting a ring-shaped binding member into a spot punched by the punching process, and binding those sheets. This process is called "wire bookbinding function", "ring bookbinding function", or the like after the shape of the binding member used for the binding process.

As an example of a binding method using the ring bookbinding process, there is known a method of obtaining a bookbinding printed product by inserting the binding member, which is formed of plastic or the like, into a punched portion in the sheet bundle subjected to punching processing. As another example of a binding method using the ring bookbinding function, there is known a ring bookbinding process for inserting a wire binding member, which is formed of a metal or other such material and cut so as to have an appropriate length in accordance with the width of a sheet, into the punched portion in the sheet bundle subjected to punching processing and performing bending processing on the wire binding member. The latter method is different in the binding member to be used but those methods include the same steps, and hence those methods are referred to collectively as "wire bookbinding function" in the following description. In order to be distinguished from a binding step using a staple or the like, a binding step described herein is referred to as "wire binding".

The following problem exists regarding the wire bookbinding function of cutting the binding member so that the binding member has the appropriate length. Now, it is assumed that, in the execution process of the wire bookbinding process, some failure has occurred in a wire bookbinding function processing apparatus and an associated apparatus in conveyance of sheets. Specifically, for example, the failure means occurrence of a jam of sheets. In a recent image forming apparatus, such occurrence of a jam and a location where the jam has occurred can be detected by various kinds of sensors.

When occurrence of a jam has been detected, print processing is first stopped at an appropriate timing, and subsequent print processing is suspended temporarily or a print job itself, which is related to creation of the printed product, is stopped. Next, a user of the image forming apparatus is notified of the fact that a jam has occurred, and guidance information for urging recovery is presented on an operation unit or other units. When the user has removed the jam state at a location where the jam has occurred in the image forming apparatus, the various kinds of sensors detect that the jam state is removed, suspend display of the guidance information, and execute a recovery process so that the print processing can be executed. Specifically, the recovery process involves, for example, a process for creating the printed product, for example, resumption of the suspended print processing, or execution of a subsequent print job.

In the case of normal processing, the user removes a sheet that has caused a jam and a fed sheet following the sheet from the apparatus to achieve recovery at the time of occurrence of the jam. When the user removes a sheet and the like that have caused the jam from the apparatus, the binding member may deviate from a predetermined position due to, for example, the user touching a binding member arranged in the apparatus in the process for removing a sheet that has caused the jam.

In this case, even a little deviation of the position of the binding member may cause a failure in the subsequent processing. That is, even when the jam state is removed, there may cause such a phenomenon that the binding member is not inserted through a punched portion of a punched sheet at the time of processing the subsequent sheet, namely, at the time of stacking the subsequent sheet.

Further, when a jam has occurred, the user may not consider the need to remove the binding member, and the binding member that has deviated from the predetermined position may be left in the apparatus.

SUMMARY OF THE INVENTION

In order to solve the problem described above, the present invention provides an image forming apparatus configured to notify a user of appropriate operation instruction information for removing a jam that has occurred during print processing for sheets accompanied by a bookbinding process depending on the location of the jam.

According to one embodiment of the present invention, an image forming apparatus comprises:

a printer configured to perform print processing on a sheet;

a puncher configured to punch the sheet printed by the printer;

a binder provided with a stacking portion on which a plurality of sheets punched by the puncher are to be stacked, the binder being configured to perform a bookbinding process so as to form a bound product in which a binding member penetrates punch holes of the plurality of sheets stacked on the stacking portion;

a first detector configured to detect a first jam of a sheet in the binder;

a second detector configured to detect a second jam of a sheet which occurs upstream of the binder in a conveyance direction of the sheet;

an annunciator configured to notify information; and a controller configured to cause the annunciator to notify first instruction information for instructing removal of a sheet and the binding member, which are located in the binder and for which the bookbinding process is incomplete, in a case where the first detector has detected the first jam, and cause the annunciator to notify second instruction information for instructing removal of the second jam in a case where the second detector has detected the second jam and the first detector has not detected the first jam.

Further features of the present invention will become apparent from the following description of exemplary embodiments with reference to the attached drawings.

DESCRIPTION OF THE EMBODIMENTS

Now, exemplary embodiments for carrying out the present invention are described below with reference to the accompanying drawings. The following embodiments are not intended to impose a limitation on the invention according to the appended claims, and every combination of features described in the embodiments is not necessarily mandatory for achieving the invention.

<Description of System Configuration>

First Embodiment

First, a first embodiment of the present invention is described.

Figure 1:
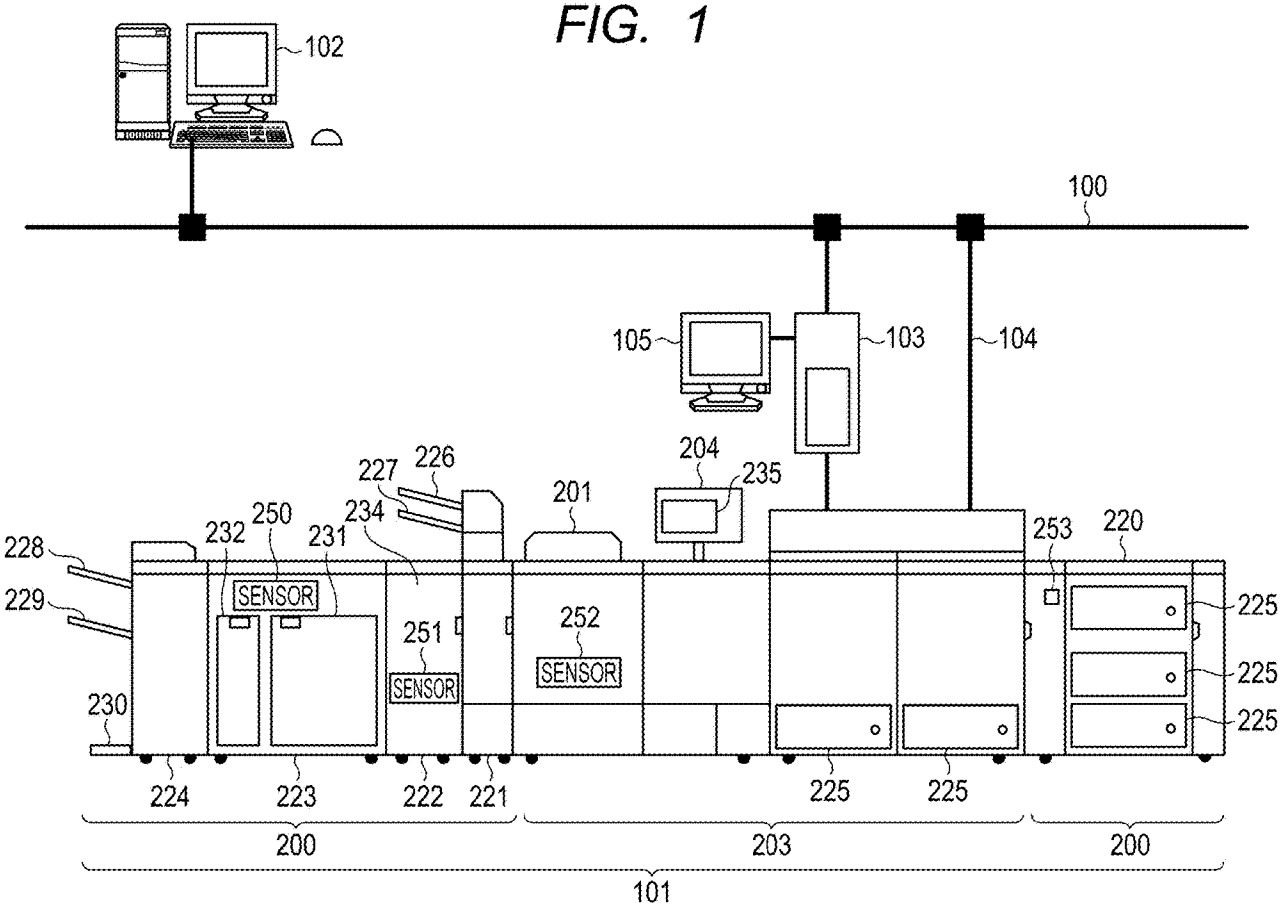
FIG. 1 is a block diagram for illustrating a printing system.

FIG. 1 is a block diagram for illustrating a printing system including an image forming apparatus according to the first embodiment of the present invention. In the first embodiment, a multifunction peripheral (MFP) 101 is described as an example of the image forming apparatus, and a PC 102 is described as an example of a data processing apparatus. The MFP 101, configured to connect a punching device for performing a punching process described later to a bookbinding device for performing a bookbinding process each other to perform a sheet post-process, and the PC 102, configured to generate print information and transmit the print information to the MFP 101, are communicably connected to each other via a network 100.

First, the PC 102 will be described. The PC 102 can execute different kinds of programs, for example, an application program for submitting a print job. A printer driver having a function of converting print data into a printer language compatible with the MFP 101 is installed in the PC 102. A user who desires to perform printing can give a print instruction from each of different kinds of applications or the like. The printer driver can convert data to be output by the application based on the print instruction into the print data that can be interpreted by the MFP 101, and transmit the print data to the MFP 101 connected to the network 100.

In the first embodiment, the data processing apparatus is exemplified by a PC, but may be, for example, a smartphone, a tablet terminal, or other such portable information terminal. A method of transmitting the print data to the image forming apparatus can appropriately be modified. The print data may be transmitted to the image forming apparatus via an application or driver for printing, or may be transmitted to the image forming apparatus via a cloud server.

Next, the MFP 101 will be described. The MFP 101 has a reading function of reading an image on a sheet and a print function of printing an image on a sheet. The MFP 101 also has a post-processing function of binding a plurality of sheets on each of which an image has been printed, aligning the plurality of sheets, and sorting delivery destinations of the plurality of sheets into a plurality of trays. The sheets include plain paper, thick paper, and other such paper and films.

In the first embodiment, the MFP 101 is described as an example of the image forming apparatus, but the image forming apparatus may be, for example, a printer that does not have the reading function. In the first embodiment, as an example, the image forming apparatus is assumed to include different kinds of components described below.

The MFP 101 may be provided with a print control apparatus 103 having part of functions included in the MFP 101 and other auxiliary functions. In this case, from the viewpoint of the PC 102, the print control apparatus 103 can be regarded as providing the functions of the MFP 101 through the network 100. The print control apparatus 103 can be accompanied by different kinds of input/output devices, for example, a display apparatus (monitor) 105, which are the same input/output devices included in the PC 102. Even when the print control apparatus 103 is mounted in such an auxiliary manner, the MFP 101 may be configured so as to be connectable directly to the network 100 through use of a network cable 104. Each of sections forming the MFP 101 is described below.

A printer portion 203 is configured to form (print) an image on a medium (sheet) fed from a sheet feeding portion through use of a toner based on the image data. A configuration and an operation principle of the printer portion 203 are as follows.

A light beam, for example, laser light, which has been modulated based on the image data, is reflected by a rotary polygon mirror and applied to a photosensitive drum as scanning light. An electrostatic latent image formed on the photosensitive drum by the laser light is developed with a toner, and a toner image obtained in this manner is transferred onto the sheet stuck on a transferring drum. A series of image forming processes are sequentially executed for toners of yellow (Y), magenta (M), cyan (C), and black (K), to thereby form a full-color image on the sheet. The sheet on the transferring drum, on which the full-color image has been formed in this manner, is conveyed to a fixing device. The fixing device includes a roller and a belt, and also includes a built-in heat source, for example, a halogen heater, inside the roller. The fixing device is configured to apply heat and pressure to the toner on the sheet, onto which the toner image has been transferred, to fix the toner to the sheet.

The printer portion 203 of the MFP 101 of the first embodiment is provided with a scanner portion 201 and an operating portion 204 arranged on an upper surface of the printer portion 203. The operating portion 204 serving as an annunciator configured to notify information provides different kinds of interfaces used when the user performs different kinds of settings, operations, and the like on the printer portion 203 of the first embodiment. The MFP 101 is also configured so that different kinds of auxiliary devices can be mounted thereto in addition to the printer portion 203. The printer portion 203 includes a sensor (second detector) 252 configured to detect a jam, and adopts such a configuration that output of the sensor 252 is notified to a controller 205.

A large-capacity sheet feeding apparatus 220 is a sheet feeding apparatus that is removably mounted to the printer portion 203. The sheet feeding apparatus includes a plurality of sheet feeding portions 225. With such a configuration, the printer portion 203 can perform a print process on a large volume of sheets. The large-capacity sheet feeding apparatus 220 includes a sensor 253 configured to detect a jam, and adopts a configuration in which output of the sensor 253 is notified to the controller 205. The sheet feeding portions 225 are included in the printer portion 203 as well, and the printer portion 203 can execute a function similar to that of the sheet feeding apparatus 220. Those sheet feeding portions 225 included in the printer portion 203 are also referred to as "sheet feeding system apparatus" in this description.

An inserter 221 is used for inserting an inset having an image formed thereon without intervention of the printer portion 203 to a bundle of sheets each having an image formed thereon by the printer portion 203 so as to obtain printed products. In FIG. 1, there is illustrated an apparatus including two trays 226 and 227.

A punching device 222 serving as a puncher configured to perform a punching process is configured to perform a process (sheet post-process), for example, a punching process, on the sheet fed by the printer portion 203 or the inserter 221. The apparatus in the example illustrated in FIG. 1 has a part called "die" internally in a replaceable manner. Thus, the apparatus includes a door 234 for replacing the die. This apparatus is described in detail later. Regarding the internal die, different punching processes can be performed using a plurality of dies having different sizes of holes for punching or having different numbers of holes. The punching device 222 includes a sensor 251 configured to detect a jam, and adopts a configuration in which output of the sensor 251 is notified to the controller 205.

A bookbinding device 223 serving as a binder is configured to execute a characteristic bookbinding process in the first embodiment. Specifically, the bookbinding device 223 is configured to cause a binding member to penetrate a hole portion in the sheet subjected to the punching processing by the punching device 222, and to deform the binding member, to thereby obtain a bookbinding printed product 423. The created bookbinding printed products 423 are stacked on a printed product tray 422 arranged inside of the bookbinding device 223. The user can access the bookbinding printed products 423 stacked on the printed product tray 422 by opening the door 231. The bookbinding device 223 further includes a door 232 configured to be able to be opened and closed when the binding member is replenished. The door 231 is opened so that the user can access the sheet conveyance path inside the bookbinding device 223 in a case where, for example, a jam has occurred in the bookbinding device 223. The bookbinding device 223 is described later in detail. The bookbinding device 223 includes a sensor (first detector) 250 configured to detect a jam, and adopts a configuration in which output of the sensor 250 is notified to the controller 205.

A finisher 224 is provided in order to perform staple binding processing on a plurality of sheet bundles. Possible types of staple binding include corner binding, two-position binding, saddle bookbinding stitching, and other such binding process having a format desired by the user. The finisher 224 is configured to deliver the printed product subjected to the binding process to trays 228 and 229 in a case of the corner binding or the two-position binding and to deliver the printed product to a tray 230 in a case of the saddle bookbinding stitching. The inserter 221, the punching device 222, the bookbinding device 223, and the finisher 224 are referred to collectively as a sheet processing apparatus 200 of the post processing system.

Meanwhile, in FIG. 1, the devices arranged on the left side of the printer portion 203 are referred to collectively as "sheet post-processing apparatus". The sheet post-processing apparatus is configured to perform different kinds of post-processes and a stacking process on the sheet that has been subjected to the print process. The sheet feeding system apparatus described above and the sheet post-processing apparatus are referred to collectively as "sheet processing apparatus 200" in the following description. Next, a configuration (mainly, software configuration) of the MFP 101 of the first embodiment will be described.

Figure 2:
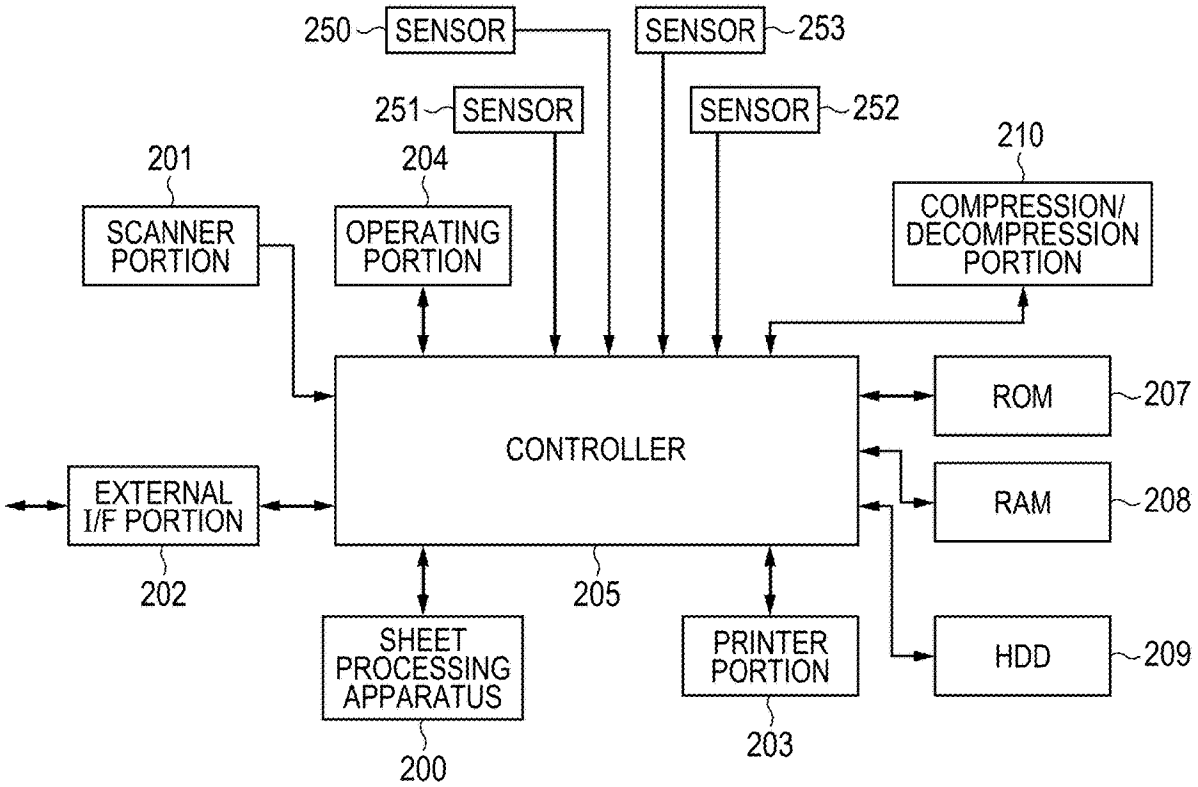
FIG. 2 is a functional block diagram for illustrating a functional configuration of a multifunction peripheral (MFP) illustrated in FIG. 1.

FIG. 2 is a functional block diagram for illustrating a functional configuration of the MFP 101 of FIG. 1. Blocks illustrated in FIG. 2 are divided into units in terms of a system, and hence the units do not necessarily correspond to those of the device components illustrated in FIG. 1.

In FIG. 2, the MFP 101 includes a hard disk drive (hereinafter referred to as "HDD") 209 or other such non-volatile memory capable of storing data on a plurality of jobs to be processed inside the own apparatus.

The MFP 101 has a copy function of storing data received from the scanner portion 201 in the HDD 209, reading the data from the HDD 209, and performing printing by the printer portion 203. The MFP 101 also has, for example, a print function of storing job data received from an external apparatus through an external I/F portion 202, which exemplifies a communication portion, in the HDD 209, reading the job data from the HDD 209, and performing printing by the printer portion 203.

The scanner portion 201 is configured to read an original image, and perform image processing on the image data obtained by reading the original to output the image data. The external I/F portion 202 is configured to transmit and receive the image data or the like to/from a facsimile machine, a network-connected device, or an external dedicated apparatus. The HDD 209 also stores different kinds of management information or the like which are permanently stored, changed, and managed by the MFP 101. The MFP 101 also includes the printer portion 203 configured to execute the print process for the job data to be printed which is stored in the HDD 209. The MFP 101 also includes the operating portion 204 including a display 235, which corresponds to an example of a user interface portion.

The controller 205 corresponding to an example of a controller included in the MFP 101 includes a CPU (not shown), and is configured to centrally control processing and operations of different kinds of units included in the MFP 101. A ROM 207 stores different kinds of control programs required in the first embodiment, which include programs for executing different kinds of processing or the like of flowcharts described later to be executed by the controller 205. The ROM 207 also stores a display control program for displaying different kinds of user interface screens (hereinafter referred to as "UI screens") on the display 235 of the operating portion 204, which includes the UI screens.

The CPU of the controller 205 reads and executes the programs stored in the ROM 207, to thereby cause the MFP 101 to execute different kinds of operations of the first embodiment. The ROM 207 also stores, for example, a program for causing the controller 205 to execute an operation for interpreting page description language (hereinafter referred to as "PDL") data received from the external apparatus through the external I/F portion 202 and decompressing the PDL data into raster image data (bitmap image data).

In the same manner, the ROM 207 stores, for example, a program for causing the controller 205 to interpret and process the print job received from the external apparatus through the external I/F portion 202. Those are processed in a software manner. The ROM 207 is a memory that allows only reading, and stores in advance different kinds of programs including programs for a boot sequence, font information, and the like and the above-mentioned programs. The different kinds of programs stored in the ROM 207 are described later in detail. A RAM 208 is a memory that enables reading and writing, and stores image data transmitted from the scanner portion 201 and the external I/F portion 202, the different kinds of programs, setting information, and the like.

The HDD 209 stores the image data compressed by a compression/decompression portion 210. The controller 205 stores the data on the job to be processed, which is input through each of different kinds of input units including the scanner portion 201 and the external I/F portion 202, in the HDD 209, reads the data from the HDD 209, outputs the data to the printer portion 203, and performs the printing. The controller 205 also performs such control that the job data read from the HDD 209 can be transmitted to the external apparatus through the external I/F portion 202. The controller 205 also controls the operation of the sheet processing apparatus 200.

Figure 3:
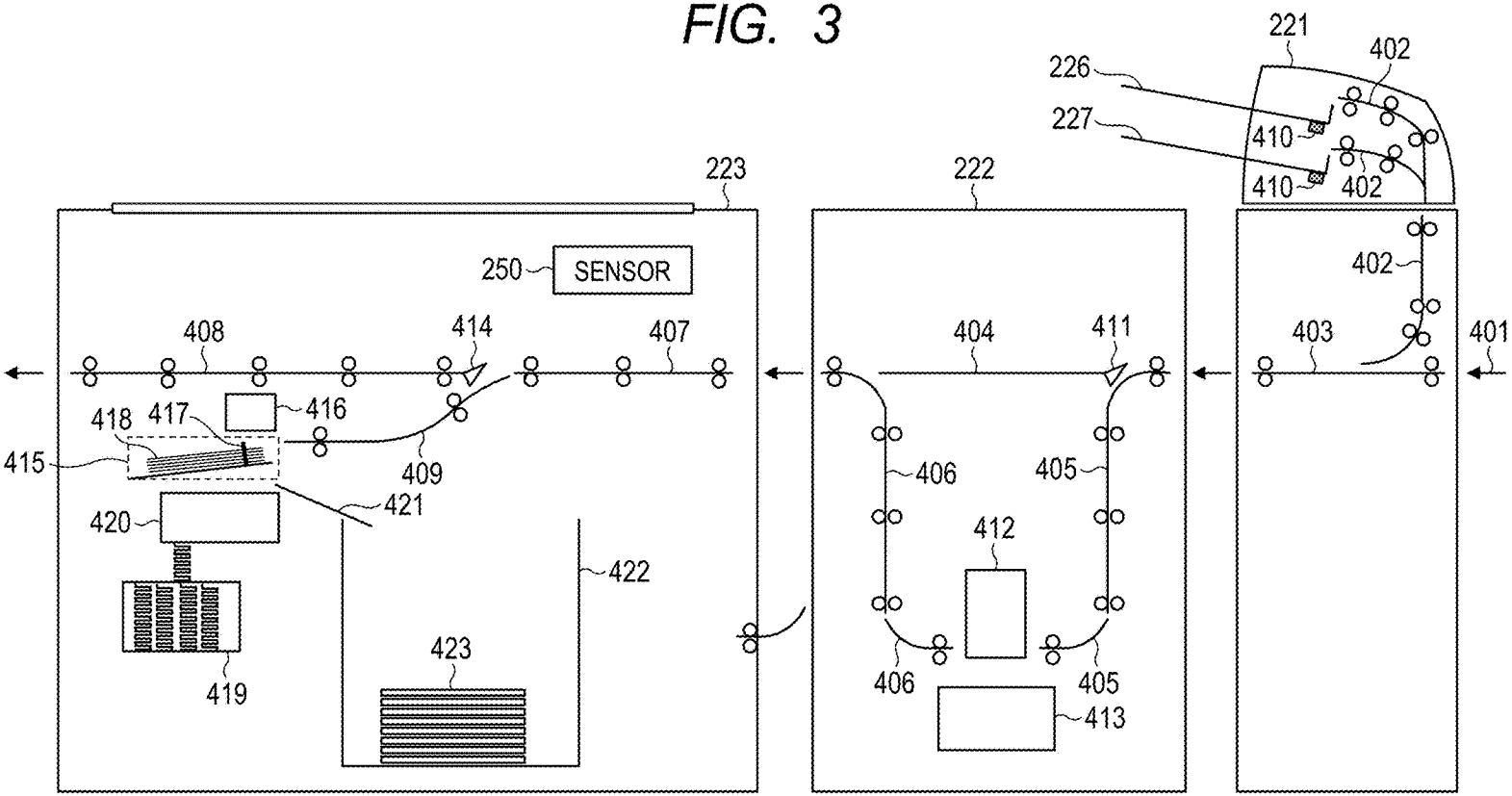
FIG. 3 is a diagram for illustrating a configuration of a sheet processing apparatus.

FIG. 3 is an illustration of the configurations of the bookbinding device 223 and the sheet processing apparatus 200 arranged around the bookbinding device 223 illustrated in FIG. 1. Specifically, in FIG. 3, the inserter 221, the punching device 222, the bookbinding device 223, members involved in the bookbinding process of those devices, and a mechanism thereof are described below. Pairs of members each having a circular shape, which are illustrated in FIG. 3, indicate schematic arrangement of rollers for conveying the sheet.

The image-formed sheet printed by the printer portion 203 is conveyed from a spot indicated by an inserter insertion path 401 to a device in the subsequent stage, that is, in the first embodiment, a conveyance path 403 inside the inserter 221. The inserter 221 is also configured to be able to convey the sheet to the conveyance path 403 without intervention of the printer portion 203. Specifically, the inserter 221 is configured to be able to guide the sheet placed on the tray 226 or 227 to the conveyance path 403 via a conveyance path 402. The trays 226 and 227 are each provided with a sensor 410 for enabling discrimination of whether or not the sheet has been stacked. The sheet that has passed through the conveyance path 403 is guided to the inside of the punching device 222 being a device in the subsequent stage (downstream of the inserter 221).

In the punching device 222, the sheet is guided to a different conveyance path depending on whether or not the processing to be performed by the punching device 222 is necessary. That is, in a case where the processing is unnecessary, the paper is guided to the inside of the bookbinding device 223 being a device in the subsequent stage via a conveyance path 404. Meanwhile, in a case where the processing to be performed by the punching device 222 is necessary, the paper is guided to a processing portion 412 via a conveyance path 405. The conveyance path for the sheet is switched by controlling a flapper 411 at such a position as to cause the sheet to be guided to a predetermined conveyance path. In the processing portion 412, sheet processing for performing the punching process on the guided sheet at a predetermined position thereof is executed. A section indicated by a punch chad accumulation portion 413 is a spot for accumulating punch chads. The sheet processed by the processing portion 412 is guided to a conveyance path 407 inside the bookbinding device 223 being the device in the subsequent stage (downstream of the punching device 222) via a conveyance path 406. The processing portion 412 and a type of processing performed by the processing portion 412 will be described later.

The sheet guided to the inside of the bookbinding device 223 is guided to a different conveyance path depending on whether or not the bookbinding process to be performed by the bookbinding device 223 is necessary. The conveyance path is switched by changing a position of a flapper 414 at such a position as to cause the sheet to be guided to a predetermined conveyance path. That is, in a case where the bookbinding process is unnecessary, the sheet is delivered to a device in the subsequent stage via the conveyance path indicated by a conveyance path 408. Meanwhile, in a case where the bookbinding process is necessary, the sheet is controlled so as to be guided to a conveyance path 409. The sheet guided to the conveyance path 409 is guided to a sheet stacking portion 415.

In FIG. 3, a binding member 417 and stacked sheets 418 are illustrated within the sheet stacking portion 415. As described later, the bookbinding process of the first embodiment employs a method of causing the binding member to penetrate the sheet subjected to the punching processing by the punching process, and subjecting the binding member to deformation processing, to thereby obtain the bookbinding printed product. Therefore, the sheet guided to the sheet stacking portion 415 via the conveyance path 409 needs to be subjected to the punching process having a predetermined format.

Specifically, the sheet needs to be subjected to the punching process having such a format as to enable the binding member 417 to penetrate the portion in the punched sheet subjected to the punching processing. The binding member 417 and the format of the punching process are described later. The bookbinding device 223 also includes a binding member supplying portion 420 for drawing the binding member 417 from a retaining portion 419 for the binding member by a length required for the processing of the sheet and then cutting the binding member 417, and accurately arranging the binding member 417 at a predetermined position of the sheet stacking portion 415 described above.

When the stacking of all the sheets requiring bookbinding processing is completed, the deformation processing for the binding member 417 is performed by a processing portion 416. The bookbinding printed product subjected to the binding process is obtained by the processing portion 416 as a result of the above-mentioned process. The created bookbinding printed product is guided to a printed product tray 422 via a conveyance path 421. FIG. 3 is an illustration of a state in which created bookbinding printed products 423 are stored inside the printed product tray 422.

A jam, which is a sheet conveyance failure around the conveyance path, the roller, the stacking mechanism, and the binding mechanism illustrated in FIG. 3, is notified by the sensors 250 arranged at a plurality of locations of the conveyance path to the controller 205. Sensors (not shown) are configured to notify the controller 205 of open/close states of the doors 231 and 232 included in the bookbinding device 223 and whether or not the bookbinding device 223 has succeeded in the binding process.

FIG. 4A, FIG. 4B, FIG. 4C, FIG. 4D, FIG. 4E, FIG. 4F, and FIG. 4G are diagrams for illustrating a sheet process (punching processing) in the punching device 222 illustrated in FIG. 3. This example is an example of punching processing for opening a punched hole on a sheet by the processing portion 412. The processing portion 412 is configured so that a punching mold called a die 501 illustrated in FIG. 4A can be arranged in a replaceable manner. Now, details of processing, for example, punching, performed by the processing portion 412 illustrated in FIG. 3 on a sheet are described with reference to FIG. 4A to FIG. 4G. The die 501 is replaced by an operator.

Figures 4A, 4B, 4C, 4D, 4E, 4F, 4G:
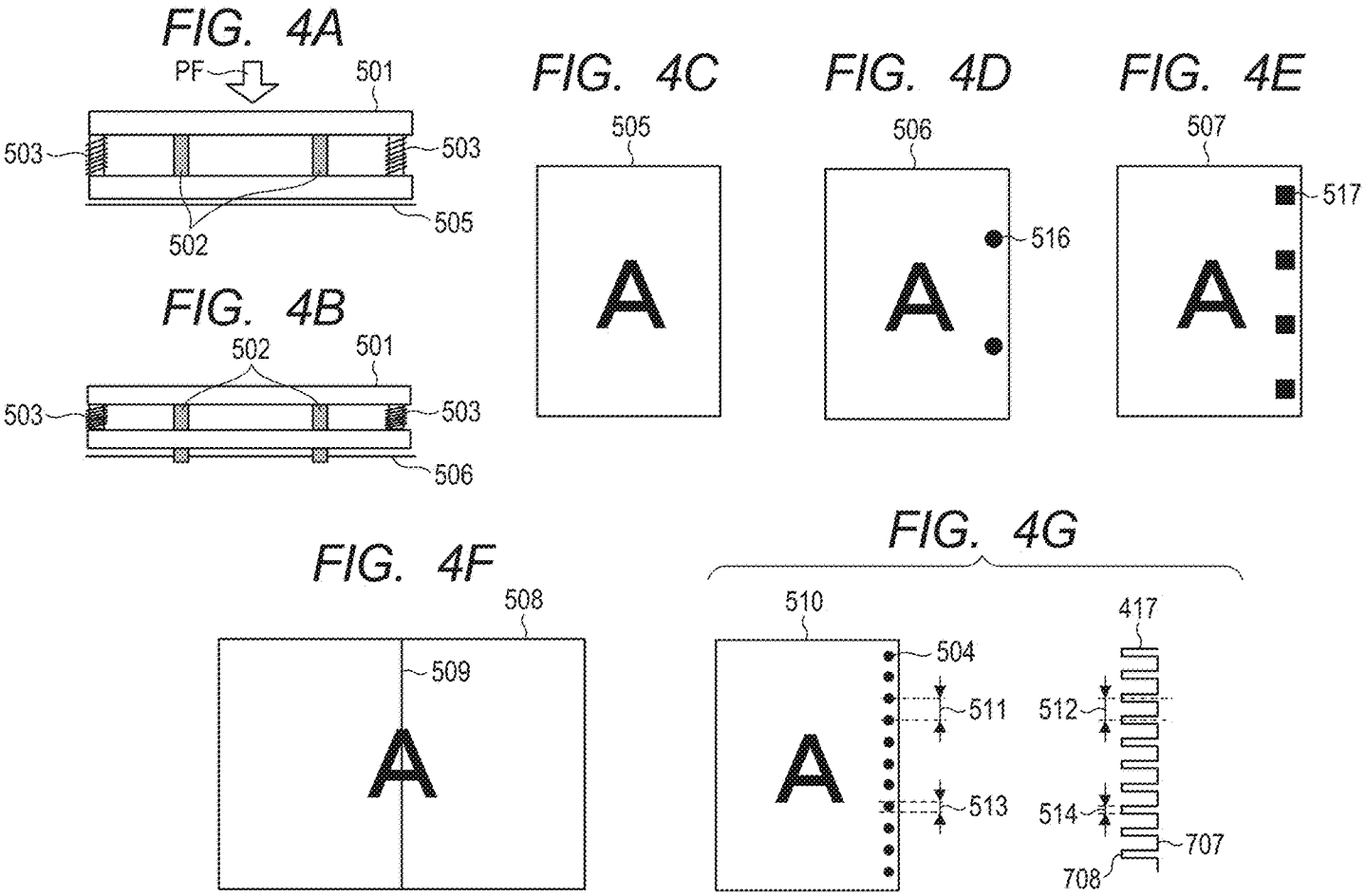
FIG. 4A, FIG. 4B, FIG. 4C, FIG. 4D, FIG. 4E, FIG. 4F, and FIG. 4G are diagrams for illustrating sheet processing.

A sheet 505 to be processed which is illustrated in FIG. 4C is a sheet to be subjected to the punching processing, and is a printed sheet or a sheet inserted from the inserter 221, which has been guided to the processing portion 412 via the conveyance path 405 in FIG. 3. The arrangement of punches 502 is robustly fixed by support columns 503. When a pressure PF is applied from above the die 501 as illustrated in FIG. 4A, the punches 502 are protruded downward as illustrated in FIG. 4B. The punches 502 each have a tip having such a sharp shape as to be appropriate for the punching process. As a result, the punching process is performed on the sheet 505 to be processed, which is placed below the die 501. A drill may be used as the punch 502.

The die 501 is provided with different kinds based on a required shape, number of holes, and the like of the punches, and is configured so as to be flexibly replaceable. For example, as illustrated in FIG. 4D, in order to obtain a printed product in which two holes 516 each having a circular shape are formed in a sheet 506 subjected to two-hole punching processing, the die 501 having a shape corresponding thereto is arranged on the processing portion 412. Meanwhile, as illustrated in FIG. 4E, in order to obtain a printed product in which four holes 517 each having a rectangular shape are formed in a sheet 507 subjected to four-hole punching processing, the die 501 having a shape corresponding thereto may be arranged on the processing portion 412 in the same manner.

The punching device 222 of the first embodiment is also capable of performing processing other than the punching process by such a mechanism of the punching device 222 as to perform processing on the sheet placed below the die 501 by applying a pressure from above the die 501. Specifically, as illustrated in FIG. 4F, it is also possible to perform processing for putting a crease 509 at a central portion of a sheet as illustrated in a sheet 508 subjected to crease putting processing. The punching process for implementing the bookbinding process of the first embodiment is described below with reference to FIG. 4G for illustrating a sheet 510 subjected to bookbinding punching processing.

As described above with reference to FIG. 3, the bookbinding process uses a mechanism for stacking sheets so as to engage the fixed binding member 417 with the holes of the sheets subjected to the punching processing. Therefore, at the time of the bookbinding process, the die 501 appropriate for the bookbinding process by the bookbinding device 223 needs to be mounted on the punching device 222. Specifically, the number of holes, which is a punching attribute, needs to match the binding member 417, which is a bookbinding attribute. This is because, as described above, the binding process requires a process for engaging the binding member 417 with hole portions 504 of the sheet 510 and deforming the binding member 417.

In addition, as illustrated in FIG. 4G, an interval 511 between holes formed in the sheet 510 and an interval 512 between penetrating portions of the binding member 417 need to match each other, and the binding member 417 cannot be caused to penetrate the hole unless a size 514 of a penetrating portion of the binding member 417 is smaller than a size 513 of the hole.

FIG. 5A, FIG. 5B, FIG. 5C, and FIG. 5D are schematic diagrams for illustrating a configuration around the sheet stacking portion 415 illustrated in FIG. 3, and are used to describe an outline of a mechanism of the binding process of the present invention.

Figure 5A:
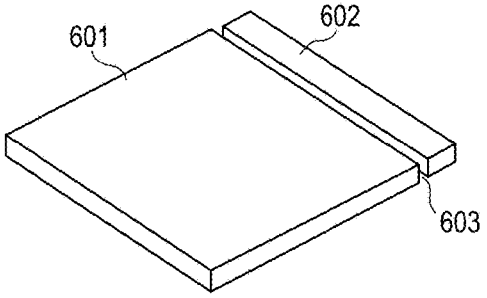
FIG. 5A, FIG. 5B, FIG. 5C, and FIG. 5D are schematic diagrams for illustrating a configuration around a stacking portion illustrated in FIG. 3.

FIG. 5A is an illustration of a state of the sheet stacking portion 415 exhibited before the processing is started. In a gap 603 between binding member fixing portions 601 and 602, the binding member 417 cut by a predetermined length, which is described with reference to FIG. 3, is arranged and fixed.

Figure 5B:
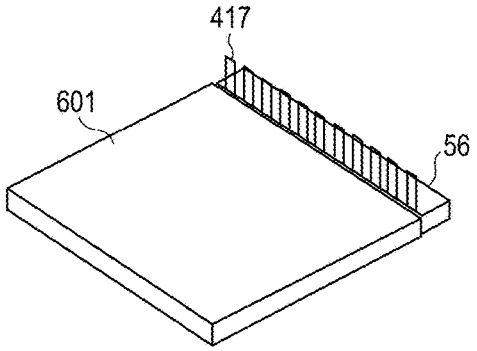
Figure 5C:
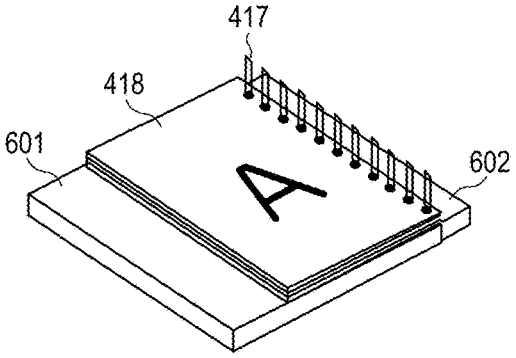
Figure 5D:
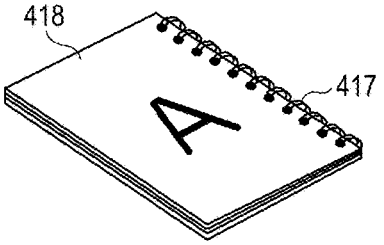

As illustrated in FIG. 5B, after the binding member 417 is supplied to the sheet stacking portion 415, the binding member 417 is accurately arranged and fixed at a predetermined position by the binding member fixing portions 602 and 601. Subsequently, the punched sheets 418 are stacked in this state so that the binding member 417 penetrates the sheets 418 as illustrated in FIG. 5C. The binding member 417 is controlled to be accurately arranged with respect to the number of holes and the position of the sheets conveyed in order to be stacked so that the binding member 417 penetrates the sheets. When the stacking up to the last sheet is completed, the binding member 417 is bent and deformed, to thereby obtain such a bookbinding printed product (bound product) as illustrated in FIG. 5D.

The shapes of the sheet stacking portion 415, members formed thereon, and the binding member 417 are simplified for description of the mechanism of the bookbinding process, and those shapes are not limited to those illustrated in FIG. 5A to FIG. 5D. For example, in order to facilitate bending processing, it is conceivable to use a binding member originally having a curved shape instead of the binding member having such a linear shape as illustrated in FIG. 5A to FIG. 5D. Different kinds of numbers of holes, intervals, shapes, and the like are also conceivable, but it is to be understood that the present invention is applied to any form of those attributes as long as the matters of the appended claims are satisfied.

FIG. 6A, FIG. 6B, FIG. 6C, FIG. 6D, and FIG. 6E are diagrams for illustrating forms of the binding portion for a printed product obtained as a result of executing the bookbinding process of the first embodiment.

Figure 6A:
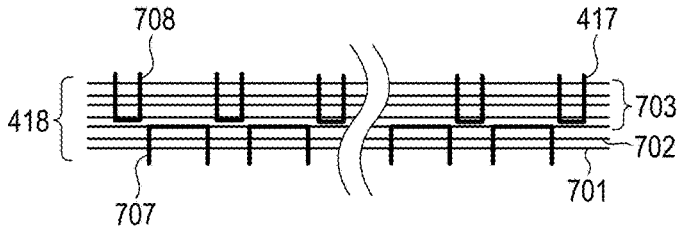
FIG. 6A, FIG. 6B, FIG. 6C, FIG. 6D, and FIG. 6E are diagrams for illustrating forms of a binding portion for printed products obtained by a bookbinding process.

The diagram of FIG. 6A is a diagram for representing the printed product as viewed from the direction of the binding portion of the bound printed product. In the state, a first sheet 701, a second sheet 702, and subsequent sheets 703 have been stacked in the sheet stacking portion 415 in the stated order of stacking and have been subjected to the binding process as they are. This is a method of bending the binding member 417 that has penetrated those sheets so as to have a ring shape, to thereby bind the sheets. Therefore, as illustrated in FIG. 6A, the binding portion is formed to have a shape in which a bottom portion 707 of the binding member 417 and the penetrating portion, that is, an upper portion 708, of the binding member 417 are alternately arranged.

However, the printed product having such a form that the bottom portion 707 and the upper portion 708 of the binding portion are alternately exposed as the printed product is considerably degraded mainly in apparent quality.

Figure 6B:
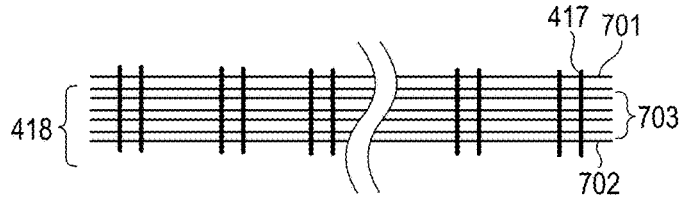

Therefore, a state illustrated in FIG. 6B is achieved in which the first sheet 701 of the printed product subjected to execution of the binding process has been turned over toward an opposite direction of the bookbinding printed product. In this manner, it is possible to resolve the state illustrated in FIG. 6A in which the bottom portion 707 and the upper portion 708 are exposed, and to obtain the printed product having apparently preferred quality. In addition, an order in which the sheets of the printed product are stacked is determined as an order that assumes such a process for turning over the first sheet 701 toward the opposite direction.

In addition, the binding member 417 having a predetermined size is supplied to the bookbinding device 223, while the number, or a bundle thickness, of the sheets that form the bookbinding printed product is variable depending on the number of pages of print job data and the type of sheets to be used. In order to obtain bookbinding printing products having various bundle thicknesses on the assumption of such a fact, the bookbinding device 223 presupposes such a configuration as to be able to appropriately create a bookbinding printed product having a different bundle thickness by enabling the binding member 417 to be replaced by one having a different size.

Figure 6C:
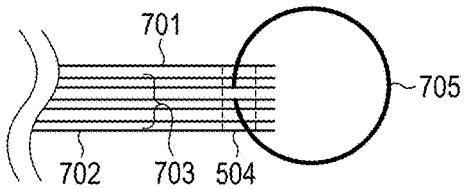
Figure 6D:
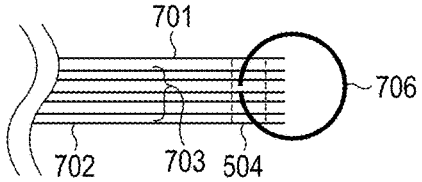

For example, FIG. 6C and FIG. 6D are illustrations of the bookbinding printed products viewed from directions of cross sections of the binding members 705 and 706 in the case of using the binding members 705 and 706 having different sizes. However, even the sheet bundles having the same bundle thickness can be subjected to the binding process using the binding members 705 and 706 having different sizes unless the bundle thicknesses exceed the sizes of the binding members 705 and 706.

Figure 6E:
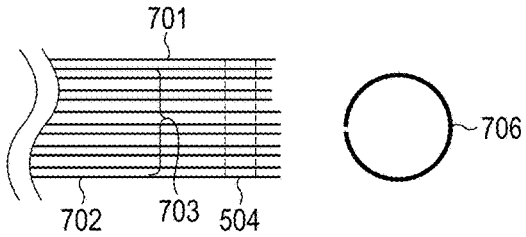

However, a preferred printed product is obtained by using the binding member 705 or 706 having a size appropriate for the bundle thickness. It should be understood that the above-mentioned preference depends on a subjective point of view of the user who uses the MFP 101. However, as illustrated in FIG. 6E, the sheet bundle thickness may exceed the size that enables the binding member 706 to bind the sheet bundle. In this case, the bookbinding device 223 cannot execute the process for creating the bookbinding printed product irrespective of the above-mentioned subjective point of view of the user. In this case, the user has no way of obtaining a normal printed product other than to perform the process by reducing the bundle thickness or replacing the binding member 705 by one having a larger size.

Figure 7:
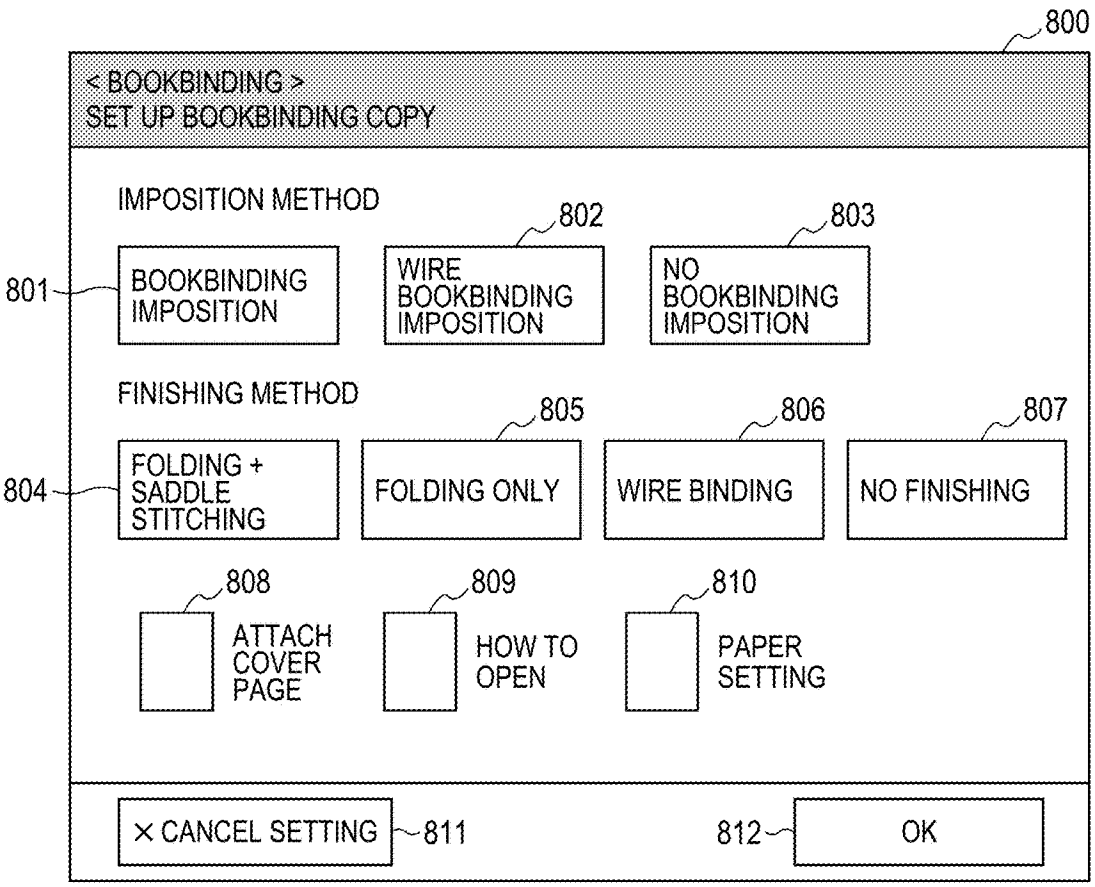
FIG. 7 is a diagram for illustrating a UI screen to be displayed on an operating portion.

FIG. 7 is a diagram for illustrating a UI screen to be displayed on the display 235 of the operating portion 204. This example is an example of a setting screen in a copy job. In FIG. 7, buttons corresponding to various kinds of necessary settings are arranged so that a bookbinding setting screen 800 can be used to perform various kinds of settings relating to creation of the bookbinding printed product. As described above, information input to the operating portion 204 by the operator is transmitted to the controller 205, and a screen displayed on the operating portion 204 is switched by an instruction received from the controller 205.

When receiving an instruction to display the bookbinding setting screen 800 from the operator, the controller 205 displays the bookbinding setting screen 800 illustrated in FIG. 7 on the operating portion 204. The bookbinding setting screen 800 is one of the screens relating to the setting of copy, and is a screen for designating bookbinding imposition and finishing.

In FIG. 7, imposition designation buttons 801 to 803 are buttons for designating a method of arrangement of images (imposition). A selected imposition designation button is displayed in a color different from the other buttons. A plurality of imposition designation buttons are not simultaneously brought to a selected state. In a case where one imposition designation button is selected with another imposition designation button being already in a selected state, the newly selected imposition designation button is brought to a selected state, and the selected state of the imposition designation button that was previously in the selected state is canceled. In a case where a selected state of the imposition designation button is stored in the RAM 208, the selected state is set as an initial state, and in a case where there is no stored selected state of the imposition designation button, a state in which a no-bookbinding-imposition designation button 803 is selected is set as the initial state.

The bookbinding imposition designation button 801 is one of the imposition designation buttons, and saddle stitching bookbinding imposition can be designated by bringing the bookbinding imposition designation button 801 to a selected state. In the saddle stitching bookbinding imposition, images are reordered so that two images are printed on one sheet of paper. In a finishing process, the sheet is fold at its center to obtain a book-like output product.

The wire bookbinding imposition designation button 802 is one of the imposition designation buttons, and wire bookbinding imposition can be designated by bringing the wire bookbinding imposition designation button 802 to a selected state. As described above with reference to FIG. 6A to FIG. 6E, the printed product of wire bookbinding necessitates a change in the order of stacking the paper. Specifically, the stacking order needs to be changed by reordering the images so that the last sheet of paper to be a back cover is output first. Through selection of the wire bookbinding imposition designation button 802, a process required for changing the stacking order is carried out. The wire bookbinding imposition designation button 802 is controlled to be displayed only when the bookbinding device 223 is connected to the MFP 101. In addition, the wire bookbinding imposition designation button 802 is controlled to be selectable only when the die 501 mounted to the punching device 222 configured to perform a punching process is appropriate for wire binding.

The no-bookbinding-imposition designation button 803 is one of the imposition designation buttons, and it can be designated that the bookbinding imposition is not to be performed by bringing the no-bookbinding-imposition designation button 803 to a selected state. In a case where the bookbinding imposition is not designated, one image is printed on one surface of the paper in order. Designation of single-sided printing or double-sided printing can be set on a normal imposition designation screen (not shown).

Finishing designation buttons 804 to 807 are buttons for designating a method of finishing. A selected finishing designation button is displayed in a color different from the other buttons. Further, a plurality of finishing designation buttons are not simultaneously brought to a selected state. In a case where one finishing designation button is selected with another finishing designation button being already in a selected state, the newly selected finishing designation button is brought to a selected state, and the selected state of the finishing designation button that was previously in the selected state is canceled. In a case where there is a selected state stored in the RAM 208, the selected state is set as the initial state, and in a case where there is no selected state stored in the RAM 208, a state in which a no-finishing designation button 807 is selected is set as the initial state.

The folding-and-saddle-stitching designation button 804 is one of the finishing designation buttons, and a process for folding the paper at the center and a process for binding the paper with a staple can be designated by bringing the folding-and-saddle-stitching designation button 804 to a selected state. It is possible to obtain a book-like printed product subjected to saddle stitching by designating the folding-and-saddle-stitching designation button 804 together with the bookbinding imposition designation button 801.

The folding designation button 805 is one of the finishing designation buttons, and the process for folding the paper at the center can be designated by bringing the folding designation button 805 to a selected state. It is possible to obtain a book-like printed product by designating the folding designation button 805 together with the bookbinding imposition designation button 801.

The wire binding designation button 806 is one of the finishing designation buttons, and binding using a wire can be designated by bringing the wire binding designation button 806 to a selected state. It is possible to obtain an output product subjected to the bookbinding process after being bound with a wire by designating the wire binding designation button 806 and the wire bookbinding imposition designation button 802 together. In the same manner as the wire bookbinding imposition designation button 802, the wire binding designation button 806 is displayed only when the bookbinding device 223 is connected to the MFP 101. In addition, the wire binding designation button 806 is selectable only when the die 501 mounted to the punching device 222 is appropriate for the wire binding.

The no-finishing designation button 807 is one of the finishing designation buttons, and it can be designated that the finishing is not to be performed by bringing the no-finishing designation button 807 to a selected state. In a case where the finishing is not performed, the finishing process involved in the bookbinding is not performed.

A cover page designation button 808 is a button for designating a cover page. In a case where the cover page designation button 808 is selected, the controller 205 temporarily stores the selected state of the imposition designation buttons 801 to 803 and the finishing designation buttons 804 to 807 in the RAM 208, and displays a cover page setting screen (not shown). On the cover page setting screen, it is possible to designate a type of paper and a printed surface to be used for the cover page. When the designation of the cover page setting screen is finished, the controller 205 reads the selected state of the buttons stored in the RAM 208, sets the read selected state as the initial state, and then displays the bookbinding setting screen 800 on the operating portion 204.

A how-to-open designation button 809 is a button for designating an opening direction of the bookbinding. in a case where the how-to-open designation button 809 is selected, the controller 205 temporarily stores the selected state of the imposition designation buttons 801 to 803 and the finishing designation buttons 804 to 807 in the RAM 208, and displays a how-to-open setting screen (not shown). On the how-to-open setting screen, it is possible to designate the opening direction of the bookbinding. In a case where the designation of the how-to-open setting screen is finished, the controller 205 reads the selected state of the buttons stored in the RAM 208, sets the read selected state as the initial state, and then displays the bookbinding setting screen 800 on the operating portion 204.

A paper setting button 810 is a button for designating paper to be used. In a case where the paper setting button 810 is selected, the controller 205 temporarily stores the selected state of the imposition designation buttons 801 to 803 and the finishing designation buttons 804 to 807 in the RAM 208, and displays the paper setting screen (not shown). When a setting process of the paper setting screen is finished, the controller 205 reads the selected state of the buttons stored in the RAM 208, sets the read selected state as the initial state, and then displays the bookbinding setting screen 800 on the operating portion 204.

A setting cancel button 811 is a button for finishing the bookbinding setting. In a case where the selection of the setting cancel button 811 is received, the designation of an imposition method and a finishing method performed on the bookbinding setting screen 800, the cover page setting performed on the cover page setting screen, the designation of the opening direction performed on the how-to-open setting screen, and the paper setting performed on the paper setting screen are discarded without being stored, and the screen transitions back to a previously-displayed screen.

An OK button 812 is a button for finishing the bookbinding setting. When an instruction for the OK button 812 is received, the designation of the imposition method and the finishing method performed on the bookbinding setting screen 800, the cover page setting performed on the cover page setting screen, the designation of the opening direction performed on the how-to-open setting screen, and the paper setting performed on the paper setting screen are stored in the RAM 208 as settings to be used for the copy job, and the screen transitions back to a previously-displayed screen.

In a case where a transition is made from the bookbinding setting screen 800 without an instruction for any one of the cover page designation button 808, the how-to-open designation button 809, the paper setting button 810, the setting cancel button 811, and the OK button 812, the designation of the imposition method and the finishing method performed on the bookbinding setting screen 800, the cover page setting performed on the cover page setting screen, and the designation of the opening direction performed on the how-to-open setting screen are discarded. However, in a case of a screen saver or other such screen transition that is temporary and is to return to the bookbinding setting screen 800 after being canceled, the temporarily stored setting is not discarded.

In the bookbinding setting screen 800 illustrated in FIG. 7, when the operating portion 204 gives an instruction to execute a copy job under predetermined settings, the controller 205 executes the copy job based on the bookbinding setting screen 800 or various kinds of settings (not shown). As a result, modules constructing the MFP 101 illustrated in FIG. 1 are controlled to operate.

In the following description of effects of the first embodiment, there is assumed a condition in which, on the bookbinding setting screen 800, the wire bookbinding imposition designation button 802 and the wire binding designation button 806 are selected through operation on the bookbinding setting screen 800. On the bookbinding setting screen 800, settings of the copy job other than the wire bookbinding imposition designation button 802 and the wire binding designation button 806 are unnecessary for description of effects of the present invention. Thus, any designation may be set for the wire binding process.

Figure 8:
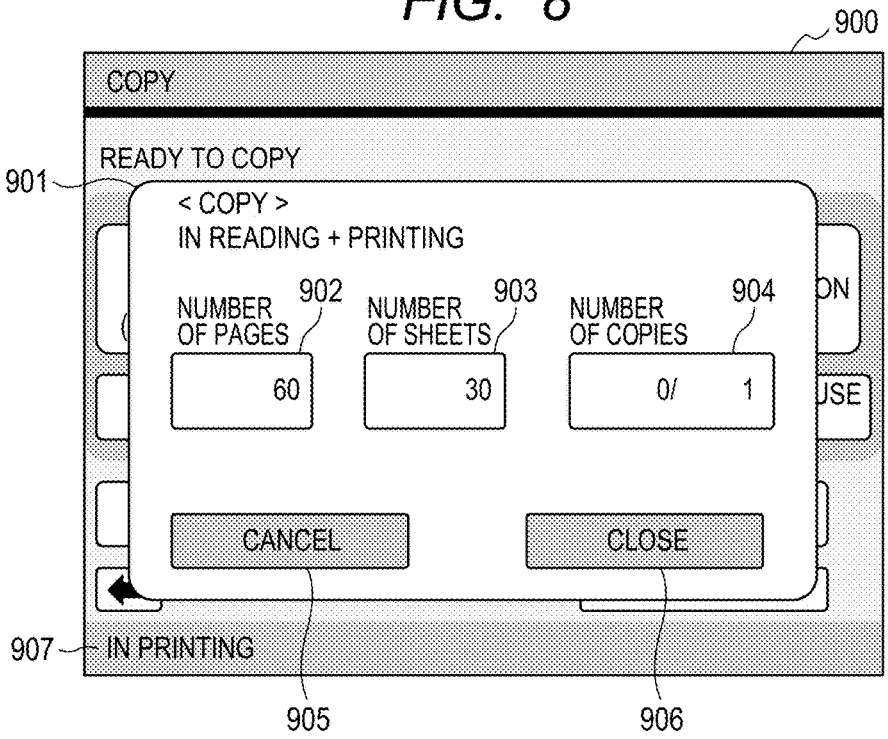
FIG. 8 is a diagram for illustrating a UI screen to be displayed on the operating portion.

FIG. 8 is a diagram for illustrating a UI screen to be displayed on the operating portion 204 illustrated in FIG. 2. This example corresponds to processing to be executed when execution of a copy job that is based on the bookbinding setting illustrated in FIG. 7 or various kinds of settings (not shown) is instructed via the operating portion 204. Specifically, this example is an example of a print status screen 900 to be displayed on the operating portion 204 in a state in which print processing is executed by the controller 205 in accordance with the copy job. The operating portion 204 is controlled by the controller 205 to perform display on the print status screen 900.

As illustrated in FIG. 8, a progress information display area 901 relating to a running copy job is displayed based on information on various kinds of settings set on the bookbinding setting illustrated in FIG. 7 and a copy job setting screen (not shown). The progress information display area 901 relating to the copy job includes a total original pages display area 902 for displaying the number of pages of originals that are read by the scanner portion 201 for printing. The progress information display area 901 further includes a sheet count display area 903 for displaying the number of printed sheets, and a print progress display area 904 for displaying a set number of copies to be printed and a number of printed copies. Among those areas, the print progress display area 904 is controlled so that, as processing of the copy job by the MFP 101 progresses, the controller 205 updates information of the print progress display area 904 on the operating portion 204 as appropriate.

In FIG. 8, in a case where a cancel button 905 is pressed, the MFP 101 is controlled by the controller 205 so as to cancel execution of the copy job. In a case where a close button 906 is pressed, the controller 205 controls the operating portion 204 to stop processing of displaying the progress information display area 901. This operation is required in a case where the user of the MFP 101 first performs other tasks, for example, setting of the next print processing in preference to confirmation of the progress status of the copy job illustrated in FIG. 8. Similarly, this operation is required, for example, in a case where the MFP 101 instructs the operating portion 204 to display other information in order to, for example, change various kinds of setting information of the MFP 101.

A status display area 907 is an area for enabling display of the processing status of the MFP 101 and information on, for example, various kinds of errors in a simplified manner. The operating portion 204 executes processing of controlling the status display area 207 and switching details to be displayed therein under control by the controller 205. The MFP 101 is configured so that the status display area 907 is always displayed at the bottom of the display area of the operating portion 204. In the example illustrated in FIG. 8, information to the effect that the MFP 101 is executing printing is presented.

Figure 9:
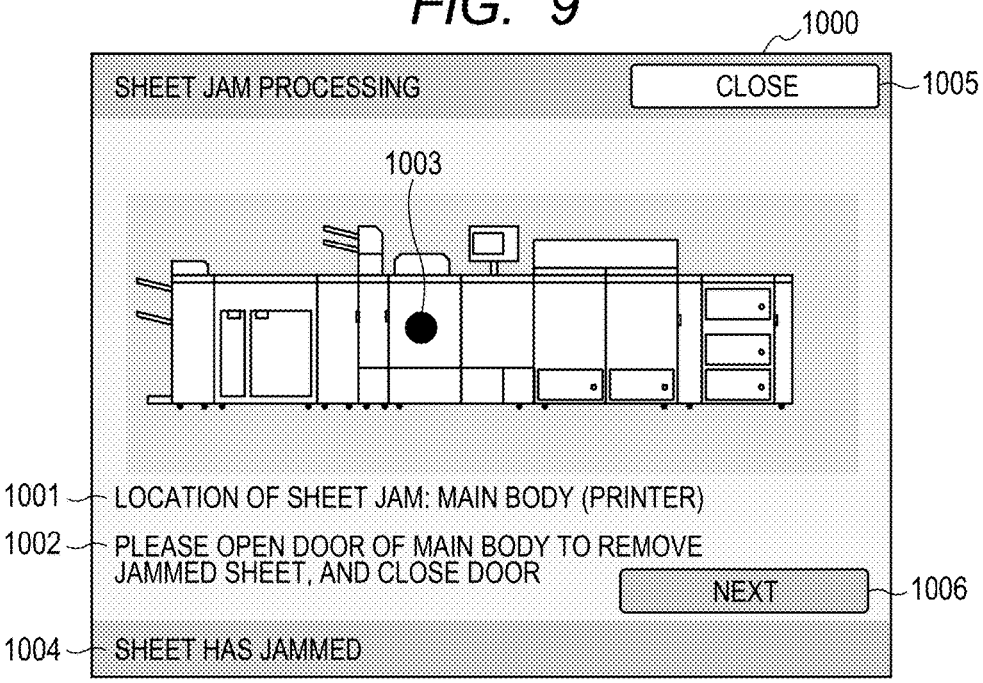
FIG. 9 is a diagram for illustrating a UI screen to be displayed on the operating portion.

FIG. 9 is a diagram for illustrating a UI screen to be displayed on the operating portion 204 illustrated in FIG. 2. This example is an example of a jam removal instruction screen 1000 to be displayed on the operating portion 204 in a case where a jam has occurred at the printer portion 203, which is upstream of the bookbinding device 223 in the sheet conveyance direction. Specifically, this example is an example of the jam removal instruction screen 1000 based on an assumption that the copy job is executed under selection of the wire bookbinding imposition designation button 802 and the wire binding designation button 806 on the bookbinding setting screen 800 illustrated in FIG. 7. The operating portion 204 executes processing of displaying the jam removal instruction screen 1000 based on control by the controller 205. Now, screen components displayed on the jam removal instruction screen 1000 are described.

Jam occurrence location detailed information 1001 is information for showing the user whether or not a jam has occurred at any one of parts of the apparatus constructing the MFP 101 illustrated in FIG. 1 or around the part at which the jam has occurred. As illustrated in FIG. 9, information to the effect that a jam has occurred in the printer portion 203 is presented. Similarly, a marker 1003 is displayed together with an external view of the MFP 101, which means that a configuration is adopted in which a method of enabling the user of the MFP 101 to easily recognize the jam occurrence location can be provided.

In a case where a jam has occurred with the display information described above, the jam removal instruction screen 1000 is displayed to enable the user to rapidly identify the jam location and easily perform an operation of removing the jam state. An instruction information presentation area 1002 is used for specifically presenting, to the user of the MFP 101, information on processing required for removing a phenomenon that currently occurs in the MFP 101, namely, a jam at the printer portion 203 in the example of FIG. 9. In this example, the instruction information presentation area 1002 presents instruction information for instructing opening of the door of a specified part to access inside of the apparatus, removing a sheet that has caused a jam, and returning the door to the original position. The controller 205 performs display control of the operating portion 204 so that the operating portion 204 presents appropriate information on the instruction information presentation area 1002 so as to enable the user of the MFP 101 to easily remove the state based on the details and location of the phenomenon that has occurred.

A next screen transition button 1006 is used for instructing screen transition for displaying a next instruction in a case where there are a plurality of locations requiring removal of the jam state or there is an additional phenomenon to be removed because jam removal of the printer portion 203 is not enough for the MFP 101 to return to the normal state. However, in the example illustrated in FIG. 9, there is illustrated an example in which only a single jam has occurred in the printer portion 203 and there is no other processing for removal. Thus, the controller 205 controls the display status of the operating portion 204 so that the next screen transition button 1006 is grayed out and cannot be selected. With this, an unnecessary instruction to open a door is not given. In particular, it is possible to avoid an error in the restarted bookbinding process, which is caused by doors of the bookbinding device and the punching device being opened and the user carelessly touching the positioned binding member to cause the binding member to deviate to an unintended position.

The close button 1005 is a button to be used when a screen on the jam removal instruction screen 1000 is closed to transition to another screen. For example, when there is a matter to be handled by the user of the MFP 101 in preference to removal of the jam, the operating portion 204 needs to display a screen for performing the operation. However, to display the screen, the user needs to be allowed to close the screen illustrated in FIG. 10 to transition to another screen. The close button 1005 is arranged with such a case in mind. A status display area 1004 of the jam removal instruction screen 1000 presents information to the effect that a jam has occurred in the MFP 101.

Figure 10:
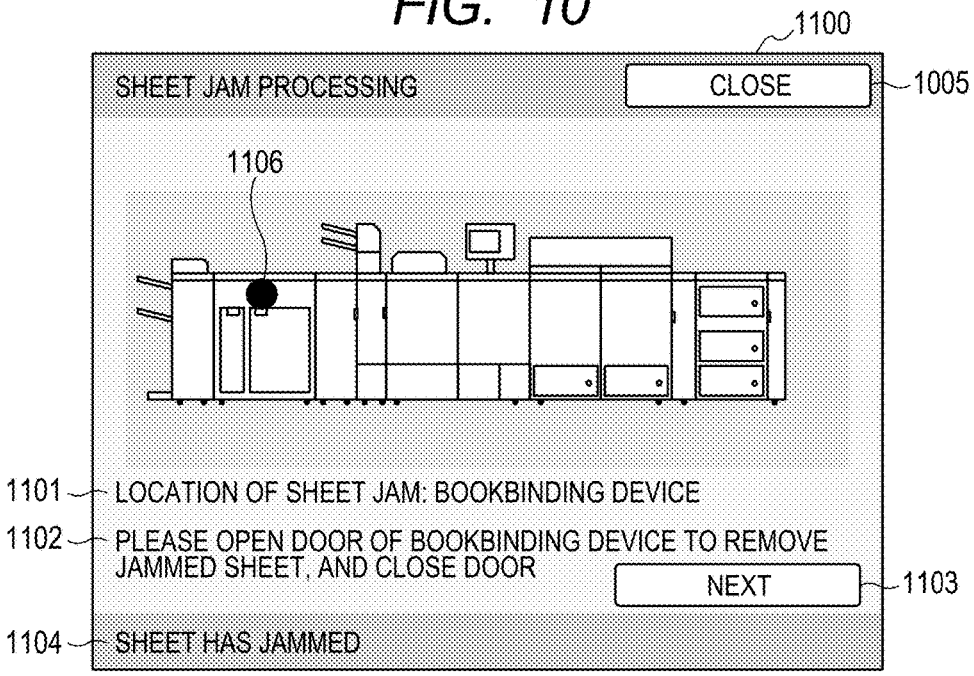
FIG. 10 is a diagram for illustrating a UI screen to be displayed on the operating portion.

FIG. 10 is a diagram for illustrating a UI screen to be displayed on the operating portion 204 illustrated in FIG. 2. This example is an example of a jam removal instruction screen 1100 to be displayed on the operating portion 204 in a case where a jam has occurred in the bookbinding device 223. Specifically, this example is an example of the jam removal instruction screen 1100 to be displayed when the copy job is executed under selection of the wire bookbinding imposition designation button 802 and the wire binding designation button 806 on the bookbinding setting screen 800 illustrated in FIG. 7. Further, FIG. 10 is an example of displaying the bookbinding device 223 as information on a location at which a jam has occurred, which is first operation instruction information. A message "Please open door of bookbinding device 223 to remove jammed sheet, and close door" is displayed. On the operation screen, the user needs to be presented with an operation instruction, and thus a button 1103 is displayed in an operable manner. The operating portion 204 executes processing of displaying the screen based on control by the controller 205. Screen components illustrated in FIG. 10 are now described below. Description of details overlapping with those of FIG. 9 are omitted.

Jam occurrence location detailed information 1101 is information for showing the user whether or not a jam has occurred at any one of parts of the apparatus constructing the MFP 101 illustrated in FIG. 1 or around the part at which the jam has occurred. In the example of FIG. 10, information to the effect that a jam has occurred in the bookbinding device 223 is presented. Further, a marker 1106 is displayed around the bookbinding device 223 in an external view of the MFP 101 in a manner different from the case illustrated in FIG. 9. With those pieces of information, the user of the MFP 101 is presented with information to the effect that a jam has occurred inside the bookbinding device 223.

An instruction information presentation area 1102 is used for specifically presenting, to the user of the MFP 101, a phenomenon that currently occurs in the MFP, a jam in the bookbinding device 223, and an operation procedure for removing those phenomena. As illustrated in FIG. 10, the instruction information presentation area 1102 presents instruction information for instructing opening of the door of a specified part, more specifically, the door 231 included in the bookbinding device 223, to access the inside of the apparatus, and removing a sheet that has caused a jam.

A next screen transition button 1103 illustrated in FIG. 10 is not grayed out contrary to the example illustrated in FIG. 9. This means that, in a case where a jam has occurred in the bookbinding device 223 illustrated in FIG. 10, an additional work needs to be done in addition to removal of a sheet that has caused the jam, which necessitates an instruction for that work. More specifically, it is to be easily understood that, during execution of print processing that has specified wire bookbinding, in a case where a jam has occurred in the bookbinding device 223, the user needs to remove a sheet that has caused the jam. However, the user may not understand the necessity to remove the binding member 417 and the stacked sheets 418 as well. In view of this, the next screen transition button 1103 for transitioning to a next instruction screen to instruct removal of the binding member 417 and the stacked sheets 418 is controlled to enable selection without being grayed out in FIG. 10. A status line 1104 indicates that the paper jam has occurred.

Figure 11:
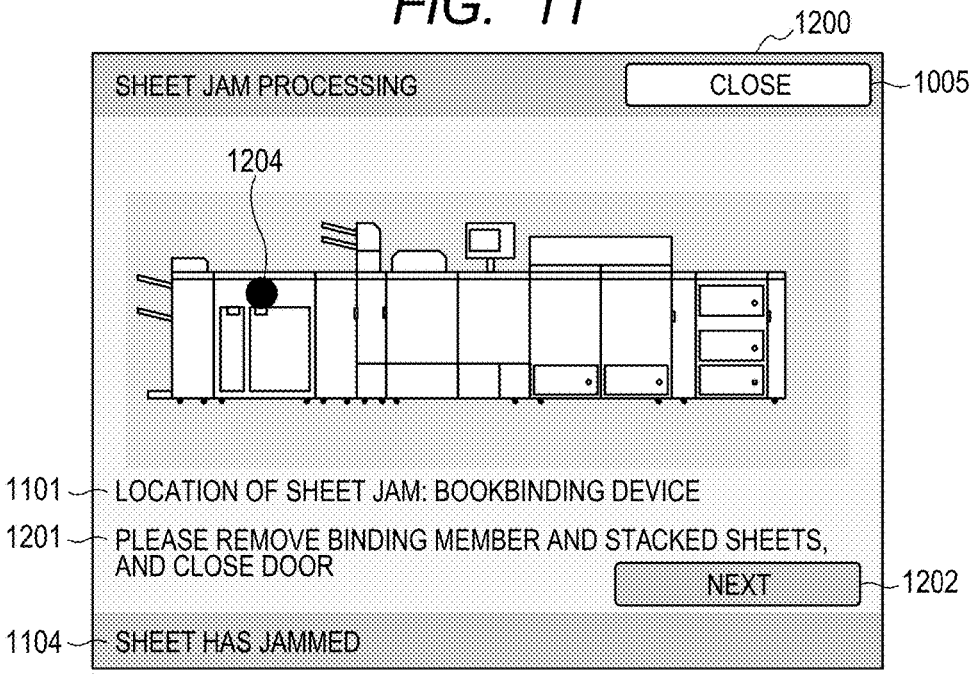
FIG. 11 is a diagram for illustrating a UI screen to be displayed on the operating portion.

FIG. 11 is a diagram for illustrating a UI screen to be displayed on the display 235 of the operating portion 204. This example is an example of a removal instruction screen 1200 to be displayed after the next screen transition button 1103 is pressed on the jam removal instruction screen 1100 illustrated in FIG. 10. The controller 205 controls processing of displaying the removal instruction screen 1200. Now, screen components illustrated in FIG. 11 are described. FIG. 11 is an example of displaying the bookbinding device 223 as information on a location at which a jam has occurred, which is first operation instruction information. A message "Please remove binding member of the bookbinding device 223 and stacked sheets, and close door" is displayed. On this operation screen, the user needs to be presented with an operation instruction, and thus a button 1202 is displayed in such a manner (gray out) as to disable selection.

A removal instruction information presentation area 1201 illustrated in FIG. 11 corresponds to a state in which information for requiring the user of the MFP 101 to remove the binding member 417 and the stacked sheets 418 is presented. The operation presented on the screen illustrated in FIG. 11 is not to remove the jam itself that has caused print processing of the MFP 101 to stop. However, because of the nature of the bookbinding device 223 included in the MFP 101, in a case where a jam has occurred inside the bookbinding device 223, information to the effect that halfway printed products, namely, the cut and arranged binding member 417 and the stacked sheets 418 also need to be removed can be presented to the user.

In the state illustrated in FIG. 11, when the binding member 417 and the stacked sheets 418 are removed and the door 231 is closed, the jam that has occurred in FIG. 10 and all the recovery processing associated therewith are complete. Thus, the user of the MFP 101 does not need to be given an additional instruction by the next screen transition button 1202 illustrated in FIG. 11. Therefore, the controller 205 controls display of the operating portion 204 so that the next screen transition button 1202 is grayed out and cannot be selected in FIG. 11.

Figure 12:
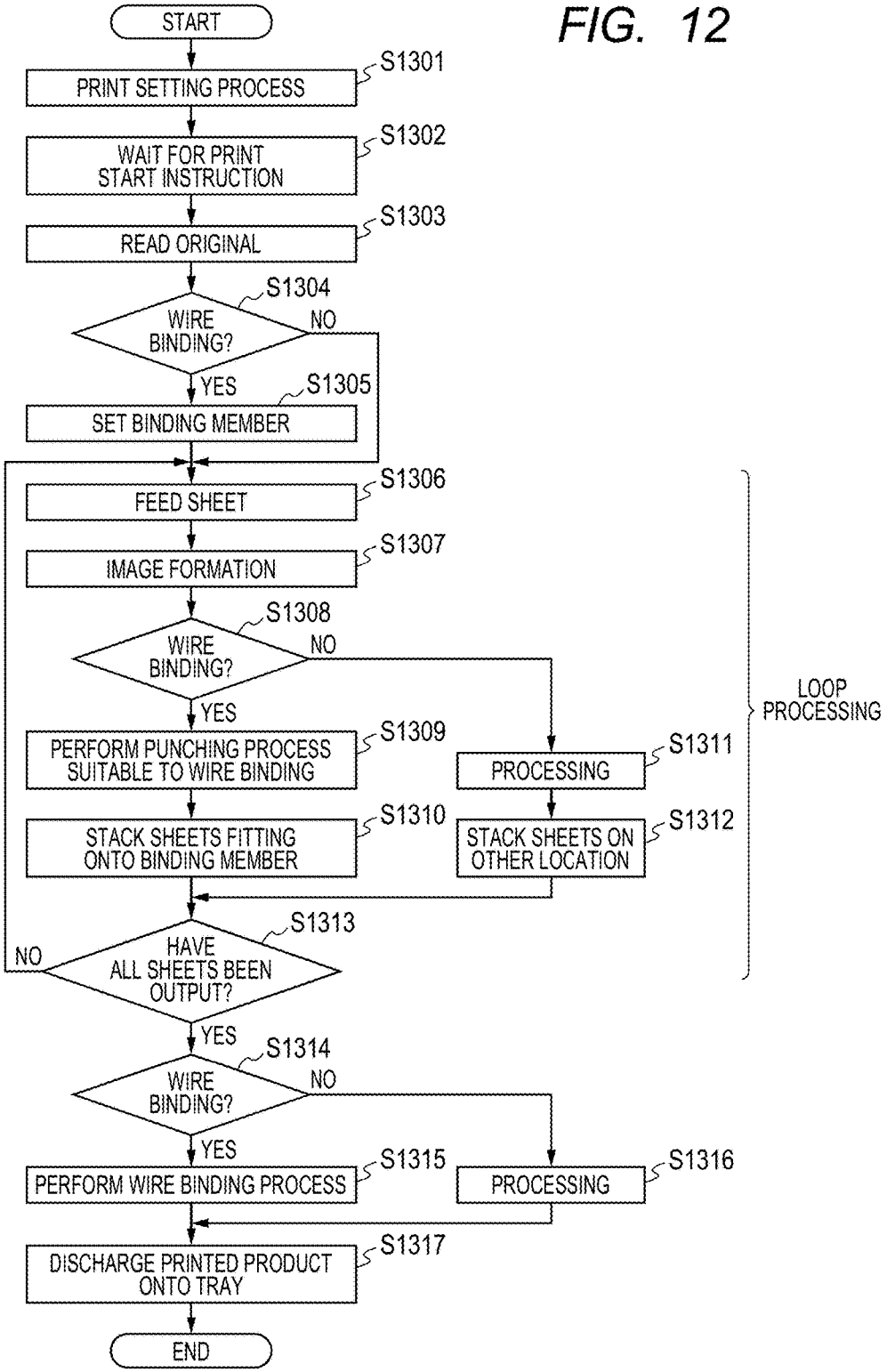
FIG. 12 is a flowchart for illustrating a control method for an image forming apparatus.

FIG. 12 is a flowchart for illustrating a control for an image forming apparatus according to the first embodiment. This example is an example of processing by the controller 205 in execution of a copy job by the MFP 101. Each step is implemented by the CPU included in the controller 205 executing a control program stored in the ROM 207. In Step S1301, the controller 205 receives an operation for various kinds of settings relating to execution of a copy job. The operation in this step is executed via the operating portion 204, and an operation and input of the operating portion 204 or selected operation details are stored in the RAM 208 by the controller 205. Further, a setting operation on the bookbinding setting screen 800 illustrated in FIG. 8 is also included in this step. When the setting operation is finished by using the operating portion 204, the processing proceeds to Step S1302. In Step S1302, the controller 205 causes the operating portion 204 to wait for an instruction to start a copy job from the user of the MFP 101.

When start of the copy job is instructed, the processing proceeds to Step S1303, and the controller 205 instructs the scanner portion 201 to start processing of reading originals to be copied. Further, the controller 205 stores image information read by the scanner portion 201 into the HDD 209, and controls the modules illustrated in FIG. 2 so that the image information is held until print processing. When reading of the originals is finished, the controller 205 proceeds to print processing, namely, printed product creation processing of the copy job based on the setting set in Step S1301.

In Step S1304, the controller 205 determines whether or not wire binding is set as the setting of the copy job. When wire binding is set, in Step S1305, the controller 205 controls the bookbinding device 223 so that the binding member supplying portion 420 supplies the binding members 417 to predetermined positions of the binding member fixing portions 602 and 601 in the sheet stacking portion 415 in advance. On the other hand, in a case where wire binding is not set in Step S1304, the binding member 417 does not need to be supplied, and thus the controller 205 skips Step S1305 and proceeds to a sheet-feeding process of Step S1036 and other subsequent processes.

In Step S1306, the controller 205 causes the sheet feeding portion 225 to supply sheets to be used for print processing of the copy job, and in Step S1307, causes formation of images on sheets based on the image information stored in the RAM 208 in Step S1303.

Processing of sheets on which images are formed is different depending on whether or not wire binding is set in the copy job. Therefore, in Step S1308, the controller 205 determines whether or not the wire binding process is set in Step S1301. In the description of FIG. 4G, it is mentioned that, in a case where the controller 205 determines that the wire binding process is set, the punching process corresponding to wire binding needs to be executed. Therefore, the controller 205 proceeds to Step S1309, and the controller 205 causes the punching device 222 to perform a punching process corresponding to wire binding on sheets on which images are formed. Then, in Step S1310, the controller 205 executes processing of stacking punched sheets with the binding member 417 arranged in the sheet stacking portion 415.

On the other hand, in a case where the controller 205 determines that the wire binding process is not set in Step S1308, the punching process corresponding to wire binding is unnecessary, and thus the processing proceeds to Step S1311. In Step S1311, the controller 205 causes processing other than the set wire binding to be performed on the sheets on which images are formed, and in Step S1312, stacks those sheets in locations other than the sheet stacking portion 415, for example, the trays 228, 229, and 230. In the configuration of the MFP 101 illustrated in FIG. 1, processing of sheets on which images are formed other than wire binding corresponds to, for example, processing of sheets in a form other than a sheet 510 subjected to bookbinding punching processing illustrated in FIGS. 5A to 5D. In a case where, in Step S1301, a setting requiring some processing is not set as the setting of the copy job and sheets on which images are formed can be discharged onto, for example, the trays 228, 229, and 230 in an unprocessed state, this step does not need to be executed.

In Step S1313, the controller 205 determines whether or not all the sheets to be printed have been output. In this case, in a case where the controller 205 determines that there is a sheet to be output, the controller 205 returns the processing to Step S1306 to perform processing of outputting the sheet to be output. On the other hand, in a case where the controller 205 determines that all the sheets to be printed have been output, the controller 205 proceeds the processing to Step S1314.

A series of processing from Step S1306 to Step S1313 form loop processing. Further, the steps included in the loop processing are described in a manner of being processed sequentially in the flowchart of FIG. 12. However, the MFP 101 of the present invention can be controlled so that those flows are processed in parallel. That is, for example, the controller 205 may be configured to control the modules illustrated in FIG. 2 so that a sheet-feeding process for a subsequent sheet is not executed in Step S1306 after a sheet on which an image is formed is stacked in Step S1310 or Step S1312, but rather, the sheet-feeding process for a subsequent sheet is executed earlier in consideration of time necessary for the preceding processing in actuality.

In Step S1314, the controller 205 determines whether or not the setting process in the copy job, namely, details set in Step S1301 contain wire binding setting. In a case where the wire binding setting is contained, in Step S1315, the controller 205 causes the bookbinding device 223 to execute wire binding. Specifically, the processing portion 416 performs processing, namely, a deformation process on the binding member 417.

More specifically, as illustrated in FIGS. 6A to 6E, the bookbinding device 223 is controlled by the controller 205 to perform processing for creating the printed product illustrated in FIG. 6D by the processing portion 416 deforming and processing the binding member 417 with holes of the stacked sheets 418 engaging with the binding member 417.

On the other hand, in Step S1314, in a case where the controller 205 determines that details set in Step S1301 do not contain the wire binding setting, the controller 205 causes execution of other processing in Step S1316. Specifically, other processing corresponds to processing such as staple binding or saddle stitching performed by the finisher 224. In a case where other processing is not set in Step S1301, processing in Step S1301 may be omitted.

In a case where any one of Step S1315 and Step S1316 is finished, the controller 205 controls conveyance so that the created printed products are discharged to the trays 228 and 229 allowing discharge of the printed products, and the printed product creation process in the copy job is finished. In a case where a plurality of copies of printed products are created, the processing again returns to Step S1304 after Step S1317 is finished, to repeat the processing described above for the plurality of copies. Description of details thereof is omitted here.

Figure 13:
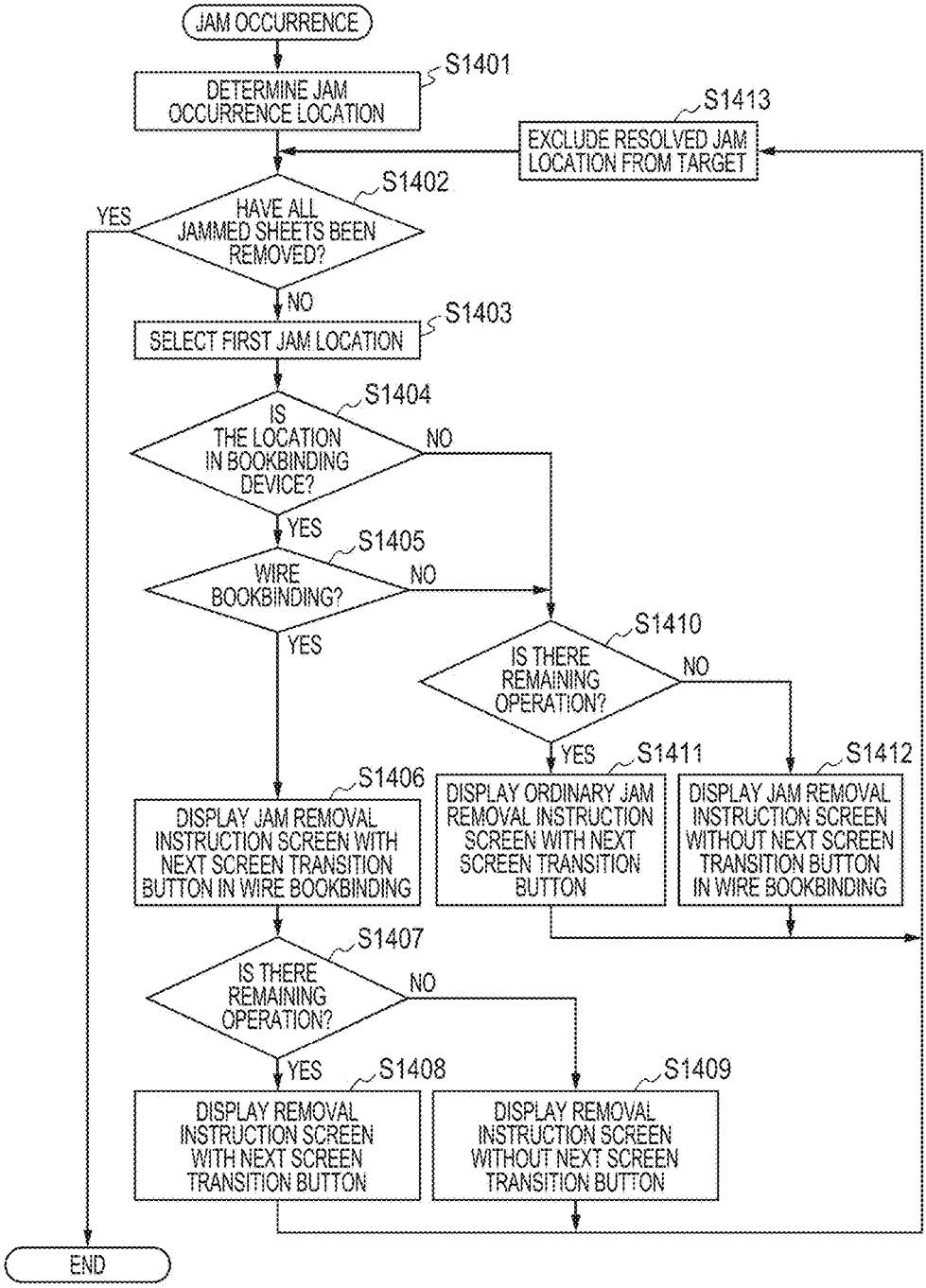
FIG. 13 is a flowchart for illustrating a control method for the image forming apparatus.

FIG. 13 is a flowchart for illustrating a control method for the image forming apparatus according to the first embodiment. This example is a flowchart for illustrating processing of the controller 205 to be executed in a case where a jam has occurred in the process steps of from Step S1316 to Step S1317 for the MFP 101 illustrated in FIG. 12. Each step is implemented by the CPU included in the controller 205 executing a stored control program.

Specifically, in the flow of processing illustrated in FIG. 12, a jam may occur in any one of the sheet-feeding process, discharge, and processing of the printed product. Therefore, the controller 205 of the MFP 101 of the first embodiment detects occurrence of a jam in the process of execution of control of the copy job illustrated in FIG. 12. The controller 205 performs control so that the flow illustrated in FIG. 12 is suspended in a case where a jam is detected and a flow of the jam removal process illustrated in FIG. 13 is executed.

In Step S1401, the controller 205 acquires a location at which a jam has occurred based on information from the sensors 250, 251, 251, and 253. The jam occurrence location is detected by the modules involved in sheet processes of from Step S1306 to Step S1316 of FIG. 12, such as the sheet processing apparatus 200 and the printer portion 203 illustrated in FIG. 2. Then, in a case where a jam is detected, the controller 205 is notified of auxiliary information, for example, the detailed location of the modules in which the jam has occurred. Further, in a case where jams have occurred at a plurality of locations of the printing system, or a jam has occurred in a preceding sheet and a subsequent sheet cannot be conveyed, the controller 205 is notified of those jams from a plurality of modules.

Thus, the processing of Step S1402 and subsequent processing form loop processing for displaying a plurality of instruction screens and presenting those screens to the user in order to remove all the jams that have occurred in those plurality of locations. As a result of determination of Step S1402, in a case where the controller 205 determines that all the jams have been removed, this flow is finished.

Any configuration may be adopted as to whether or not to resume processing from the time point at which the copy job is suspended due to the jam after the flow of FIG. 13 is finished. In Step S1402, in a case where the controller 205 determines that there is a jam to be resolved, in Step S1403, the controller 205 selects the location of the jam to be resolved, namely, the location of the jam to be removed.

In Step S1404, the controller 205 determines whether or not the selected location of the jam to be resolved is inside the bookbinding device 223. In a case where the controller 205 determines that the selected location of the jam to be resolved is within the bookbinding device 223, in Step S1405, the controller 205 determines whether or not wire bookbinding is set in the copy job.

In Step S1405, in a case where the controller 205 determines that wire bookbinding is set, that is, in a case where the controller 205 determines that a wire bookbinding job is running and a jam has occurred inside the bookbinding device 223, the processing proceeds to Step S1406. In this case, the user needs to open the door 231 included in the bookbinding device 223 to perform a jam process inside the bookbinding device 223 in order to remove the jam in the bookbinding device 223. In that case, as illustrated in FIG. 10, the binding member 417 and the stacked sheets 418 need to be removed in addition to sheets before being stacked on the sheet stacking portion 415, and thus the user of the MFP 101 needs to be presented with a notification to that effect.

Therefore, in Step S1406, as illustrated in FIG. 10, the controller 205 performs an operation of displaying a screen for removing a sheet, which is a cause of occurrence of the jam, namely, a screen for enabling the next screen transition button 1103 because a next removal work is required. The operation illustrated in the flow stays at Step S1406 until the user presses the next screen transition button 1103.

In Step S1406, in a case where the controller 205 confirms that the next screen transition button 1103 is pressed, the processing proceeds to Step S1407 and other subsequent processing. Then, the controller 205 displays the removal instruction screen 1200 required in a case where a jam has occurred during execution of the wire bookbinding process and inside the bookbinding device 223, which is illustrated in FIG. 11. The removal instruction screen 1200 is an example of a screen for instructing a next jam removal operation. In FIG. 11, there is illustrated an example of the next screen transition button 1202 grayed out on the removal instruction screen 1200. However, this is an example of a case in which the location requiring removal of an additional jam does not exist in the MFP 101, that is, a case in which display of the next jam removal screen is unnecessary.

However, in a case where the controller 205 is notified of a jam from the sheet processing apparatus 200 or the printer portion 203 other than the bookbinding device 223, the necessity of removal of the jam state needs to be displayed on the operating portion 204. In Step S1407, the controller 205 determines whether or not there is an additional work to be done for removal of the jam, that is, whether or not the next screen transition button 1202 illustrated in FIG. 11 needs to be grayed out. In a case where the controller 205 determines that an additional operation for removing the jam is necessary, in Step S1408, the controller 205 causes the operating portion 204 to display the removal instruction screen 1200 illustrated in FIG. 11 with the next screen transition button 1202 in a selectable state. In contrast, in Step S1407, in a case where the controller 205 determines that an additional operation for removing the jam is unnecessary, in Step S1409, the controller 205 causes the operating portion 204 to display the removal instruction screen 1200 illustrated in FIG. 11 with the next screen transition button 1202 in an unselectable state (grayed out state).

In any of Step S1408 and Step S1409, the controller 205 performs control so as not to allow the user to proceed to processing of Step S1408 and Step S1409 onward until the user completes removal of the halfway printed product, and closes the door 231 or presses the next screen transition button 1202.

In a case where the controller 205 determines that the door 231 is closed or the next screen transition button 1202 is pressed, the processing proceeds to Step S1413. Then, the controller 205 excludes the jam processed after Step S1403 described above from at least one jam to be removed that has occurred in the MFP 101, and the processing proceeds to Step S1402.

In this manner, the controller 205 executes control so that the operating portion 204 does not display a screen for instructing removal of the removed jam phenomenon in a duplicated manner.

Now, the description returns to Step S1404 and Step S1405 of the flowchart illustrated in FIG. 13. In Step S1404, in a case where the controller 205 determines that the location at which the jam has occurred is not inside the bookbinding device 223, or in Step S1405, in a case where the controller 205 determines that wire bookbinding is not set, the processing proceeds to Step S1410.

This processing in this case is processing to be executed in a case where it is determined that the jam selected to be resolved has occurred inside the bookbinding device 223 and the jam has occurred under a condition in which wire bookbinding is not set in the loop processing of from Step S1402 to Step S1413. In other words, the binding member 417 is not cut or arranged in Step S1305 illustrated in FIG. 12. Thus, the removal instruction screen 1200 does not require work for removing the binding member 417 and the stacked sheets 418.

Thus, contrary to processing of from Step S1406 to Step S1409, only the jam removal instruction screen for indicating the location at which the jam has occurred, namely, only the instruction corresponding to the jam removal instruction screen 1000 illustrated in FIG. 9 needs to be presented. However, in a case where there are a plurality of jam occurrence locations, control of determining whether or not to enable the next screen transition button 1103 to be pressed is necessary. Thus, in Step S1410, the controller 205 determines whether or not there is a remaining operation. That is, depending on whether or not the next screen transition button 1103 is to be grayed out on the UI screen, the controller 205 selectively switches between transition to Step S1411 and transition to Step S1412.

The processing of Step S1411 and Step S1412 does not proceed to execution of subsequent steps until the user removes the jam of the MFP 101 or the next screen transition button 1103 is pressed. The processing proceeds to Step S1413 in a case where the jam is removed or the next screen transition button 1103 is pressed. This concludes the description of the first embodiment.

According to the first embodiment, in a case where a bookbinding printed product is created, information for appropriately executing removal processing of the jam state that has occurred can be presented to the user. With this, it is possible to provide an effective method for suppressing occurrence of a wasteful sheet or binding member and occurrence of an error in the resumed bookbinding process.

Second Embodiment

Now, a second embodiment of the present invention will be described. The second embodiment will be described assuming the status of FIG. 9 in the first embodiment. That is, the second embodiment will be described assuming a case in which a jam has occurred in a location other than the bookbinding device 223, for example, the printer portion 203 in the copy job to which wire bookbinding is set.

Figure 14:
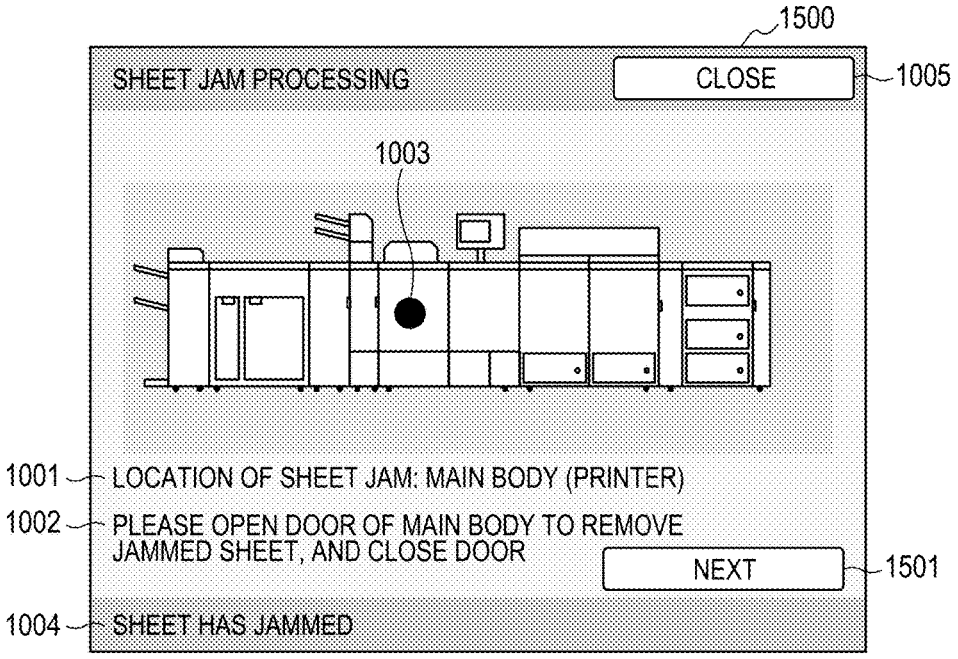
FIG. 14 is a diagram for illustrating a UI screen to be displayed on the operating portion.

FIG. 14 is a diagram for illustrating a UI screen to be displayed on the operating portion 204 illustrated in FIG. 2. In this example, in a state in which the MFP 101 illustrated in FIG. 1 is arranged under the above-mentioned condition, the user is supposed to open the door included in the printer portion 203 so as to remove the jam that has occurred in the printer portion 203. However, the user may erroneously open the door 231 of the bookbinding device 223. This screen is an example of a sheet jam processing screen 1500 displayed on the operating portion 204 by the controller 205 in such a case. The same components of the UI screen illustrated in FIG. 14 as those of the UI screen illustrated in FIG. 9 are denoted with the same reference numerals.

Also in the example illustrated in FIG. 9, the location at which a jam has occurred is the printer portion 203. Thus, the MFP 101 can recover to a state of being capable of resuming a printed product generation process by the user of the MFP 101 opening the door of the printer portion 203 and removing the jam of the printer portion 203 in accordance with an instruction of FIG. 9. However, the user may open the door 231 of the bookbinding device 223 in a state in which a jam has not occurred in the device by his or her intention, erroneous decision, or erroneous operation. In this case, only removal of the jam in the printer portion 203 may not enable the MFP 101 to return to a printable state.

Specifically, through opening of the door 231, the cut binding member 417 and the stacked sheets 418 arranged inside the bookbinding device 223 need to be removed in addition to removal of a jam that has occurred in the printer portion 203.

Thus, on the UI screen illustrated in FIG. 14, a next screen transition button 1501 is changed from the unpressable state (grayed out state) to the pressable state. Display is controlled so that jam information continues to be presented unless the user removes the jam state in the printer portion 203 and then presses the next screen transition button 1501. Display is controlled so that, in a case where the next screen transition button 1501 illustrated in FIG. 14 is pressed, the screen transitions to a screen for instructing removal of the binding member 417 and the stacked sheets 418 illustrated in FIG. 11.

Figure 15:
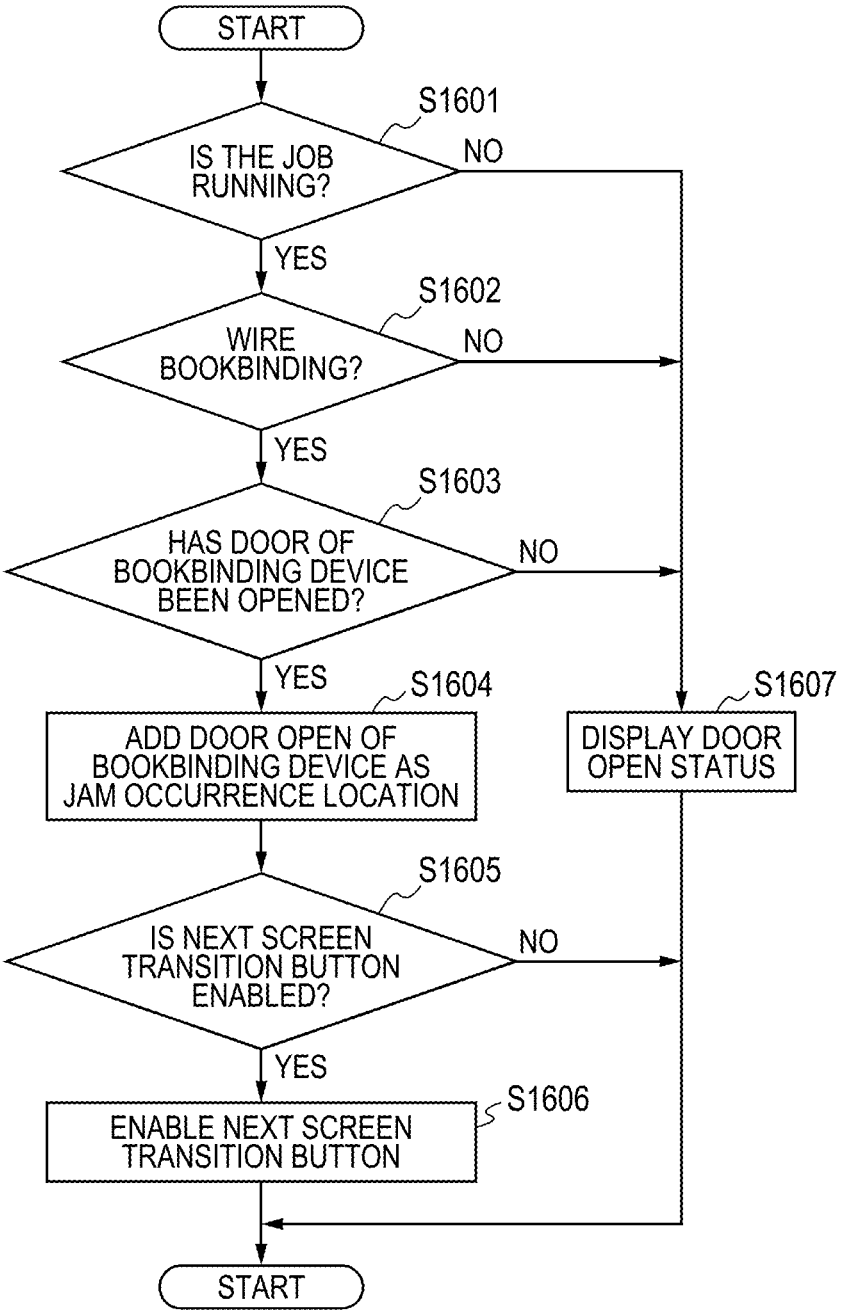
FIG. 15 is a flowchart for illustrating a control method for the image forming apparatus.

FIG. 15 is a flowchart for illustrating a control method for the image forming apparatus according to the first embodiment. In this example, in the MFP 101, it is assumed that a jam has occurred in a location other than the bookbinding device 223 during execution of a copy job and the print processing is stopped. This processing is an example of processing to be executed in a case where the controller 205 detects opening of a door in any one of the modules of the sheet processing apparatus 200 and the printer portion 203 in such a state. Each step is implemented by the CPU included in the controller 205 executing a stored control program.

Thus, in a case where opening of the door is detected, the controller 205 suspends the processing of the flow executed by the controller 205 before the detection, and executes the flow illustrated in FIG. 15.

In Step S1601, the controller 205 determines whether or not a job is running in a case where opening of the door is detected. In Step S1601, in a case where the controller 205 determines that a job is not running, the cut binding member 417 and the stacked sheets 418 are supposed not to remain in the sheet stacking portion 415 within the bookbinding device 223. In other words, the flow of presenting additional information for removing the halfway printed product described with reference to FIG. 14 does not need to be added. Therefore, in this case, the processing proceeds to Step S1607, and the status display area 1004 on the screen illustrated in FIG. 9 may display information to the effect that the door is opened as an example.

In Step S1601, in a case where the controller 205 determines that a job is running, in Step S1602, the controller 205 determines whether or not wire bookbinding is set to the running job. At this time, in a case where the controller 205 determines that wire bookbinding is not set, the processing proceeds to Step S1607.

On the other hand, in a case where the controller 205 determines that wire bookbinding is set in the running job in Step S1602, the processing proceeds to Step S1603, and the controller 205 determines whether or not the opened door is the door 231 of the bookbinding device 223.

In Step S1603, the state in which the opened door is the door 231 of the bookbinding device 223 is a state of door opening being detected during execution of the job, wire bookbinding being set to the running job, and the door 231 of the bookbinding device 223 being opened.

That is, in a case where the condition falls true, the halfway printed product needs to be removed. Therefore, even when the jam occurrence location detected in Step S1403 illustrated in FIG. 13 does not involve the bookbinding device 223, a condition for transitioning to the screen of FIG. 11 via the screen of FIG. 14 needs to be added.

Therefore, in Step S1604, the controller 205 additionally registers the phenomenon that the door 231 of the bookbinding device 223 is opened with a detection result of Step S1403. Further, the next screen transition button 1006 is grayed out on the screen illustrated in FIG. 9, but transition of screens for instructing removal of the halfway printed product needs to be executed.

Thus, in Step S1605, the controller 205 determines whether or not the state of the next screen transition button 1006 is effective, and in a case where the controller 205 determines that the state of the next screen transition button 1006 is ineffective, that is, in a case where the controller 205 determines that the next screen transition button 1006 is grayed out, the controller 205 proceeds to Step S1606 to enable transition to the next screen. Then, in Step S1606, the controller 205 controls the screen of the operating portion 204 so that the next screen transition button 1103 can be selected.

Figure 16:
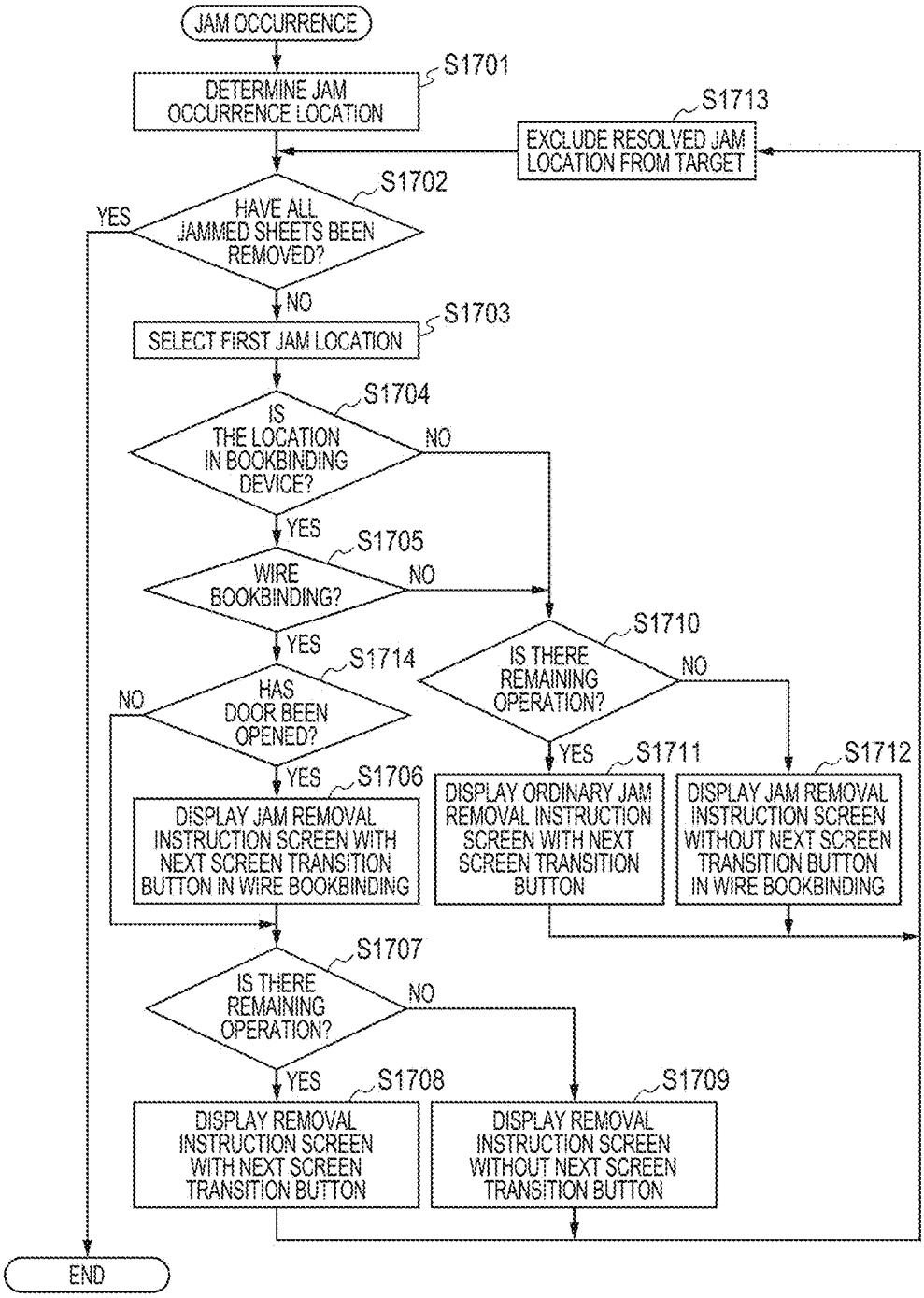
FIG. 16 is a flowchart for illustrating a control method for the image forming apparatus.

FIG. 16 is a flowchart for illustrating a control method for the image forming apparatus of the first embodiment. This example is an example of processing to be executed by the controller 205 in a case where a jam has occurred. The description of the same processing as that of FIG. 13 in the first embodiment is omitted. Step S1701 to Step S1713 of FIG. 16 are the same as Step S1401 to Step S1413 of FIG. 13. Each step is implemented by the CPU included in the controller 205 executing a stored control program.

In Step S1714, the controller 205 determines whether or not the door 231 of the bookbinding device is opened. The determination of this processing in Step S1714 results from the following case. Specifically, in the preceding Step S1704, the location at which the jam has occurred is determined to be in the bookbinding device 223. Further, in Step S1705, it is determined that wire bookbinding is set to the running job. Further, the door 231 of the bookbinding device 223 in which halfway wire bookbinding printed products are stacked is opened despite the fact that the jam phenomenon is not a jam of actual sheets but a jam that has occurred in a location other than the bookbinding device 223. Thus, determination of whether or not the door is opened in Step S1714 corresponds to determination of whether or not to cause a removal instruction.

Specifically, the controller 205 determines whether or not the jam information is added in the processing of Step S1604 in FIG. 15. Therefore, in Step S1714, in a case where the controller 205 determines that the processing of Step S1604 is not performed, the processing proceeds to Step S1707. That is, in a case where only the jam information to the effect that a jam has occurred in the bookbinding device 223 is given, the processing transitions to FIG. 10 of the first embodiment.

However, in the second embodiment, a jam has not occurred inside the bookbinding device 223, and thus it is not appropriate to display the UI screen illustrated in FIG. 11. Therefore, in the second embodiment, in Step S1714, the controller 205 performs processing of determining door opening of the door 231 for enabling display of only removal of halfway printed products in FIG. 12. This concludes the description of the second embodiment.

With this, the user who has confirmed that the button 1202 is grayed out on the display screen of FIG. 12 removes only the jam within the bookbinding device 223 and finishes the work. As a result, the user does not open a door of an apparatus in which a jam has not occurred.

Third Embodiment

Now, a third embodiment of the present invention will be described. The description is given with reference to FIG. 9 of the first embodiment. The description is given based on the assumption that the cancel button 905 is pressed on the print status screen 900 during execution of a copy job to which wire bookbinding is set.

The suspension of print processing is performed at any timing after the controller 205 is notified that pressing of the cancel button 905 is detected. However, it is not preferred that an already fed sheet stack right before the stacking portion of the MFP 101 due to suspension of the print processing.

This is because the user is forced to perform work for removing sheets present on the conveyance path due to the jam. Therefore, in the third embodiment, the conveyance process, image formation process, or processing for an already fed sheet are not stopped and the process is continued in a case where the cancel button 905 is pressed. Then, the already fed sheet is conveyed to the stacking portion, whereas the sheet-feeding process for a subsequent sheet is held.

Therefore, under the condition described above, a sheet already fed in a case where the cancel button 905 is pressed is subjected to the image formation process and punching process, and is engaged with the binding member 417 of the sheet stacking portion 415 inside the bookbinding device 223. Then, the image formation process is suspended.

The binding member 417 and the stacked sheets 418 inside the bookbinding device 223 are no longer processed as the complete printed product, and thus need to be removed. Therefore, the controller 205 may be configured to control the MFP 101 so that the screen transitions to the state of FIG. 11 after the copy job is stopped by the cancel button 905 of the print status screen 900 of FIG. 8 being pressed.

In the embodiments described above, the description is given using the bookbinding process for a punched sheet as an example. The sensor 251 included in the punching device 222 is configured to detect a jam, and thus the above-mentioned control can be applied to the jam removal process of the punching device 222 as well. In this case, display control similar to the operation screen display process by the printer portion 203 may be applied to the jam removal process of the punching device 222. Further, in a case where power of the entire printing system is turned on and, for example, it is detected that the user forgot to remove the bookbinding printed product, the controller 205 controls display of the UI screen illustrated in FIG. 10 and the UI screen illustrated in FIG. 11, to thereby be capable of instructing the user to remove the printed product appropriately.

Further, in a case where a print job for performing the bookbinding process on punched sheets is started and the job process is then suspended, the controller 205 controls display of the UI screen illustrated in FIG. 10 or the UI screen illustrated in FIG. 11, to thereby be capable of instructing the user to remove the printed product appropriately.

Further, in the printing system according to the third embodiment, the job is controlled to be resumed in units of portions after removal of the jam.

According to the third embodiment, it is possible to notify the user of appropriate operation instruction information for removing the jam in accordance with the location at which the jam has occurred during print processing for a sheet subjected to the bookbinding process.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-219577, filed Nov. 10, 2016, which is hereby incorporated by reference herein in its entirety.

What is claimed is:

1. An image forming apparatus, comprising:

a printer configured to perform print processing on a sheet;

a puncher configured to punch the sheet printed by the printer;

a binder provided with a stacking portion on which a plurality of sheets punched by the puncher are to be stacked, the binder being configured to perform a bookbinding process so as to form a bound product in which a binding member penetrates punch holes into the plurality of sheets stacked on the stacking portion;

a first detector configured to detect a first jam of a sheet in the binder;

a second detector configured to detect a second jam of a sheet which occurs upstream of the binder in a conveyance direction of the sheet;

an annunciator configured to notify information; and a controller configured to cause the annunciator to notify first instruction information for instructing removal of a sheet and the binding member, which are located in the binder and for which the bookbinding process is incomplete, in a case where the first detector has detected the first jam, and cause the annunciator to notify second instruction information for instructing removal of the second jam, in a case where the second detector has detected the second jam and the first detector has not detected the first jam.

2. An image forming apparatus according to claim 1, wherein the controller causes the annunciator to notify, of the first instruction information, first operation instruction information for removing a sheet before being stacked on the stacking portion, and subsequently causes the annunciator to notify, of the first instruction information, second operation instruction information for removing a sheet stacked on the stacking portion and the binding member.

3. An image forming apparatus according to claim 1, wherein the controller causes the annunciator to notify, as the second instruction information, third operation instruction information for removing a sheet upstream of the binder.

4. An image forming apparatus according to claim 1, wherein the controller causes the annunciator to notify location information for identifying a location at which a jam has occurred.

5. An image forming apparatus according to claim 1, wherein the binder performs a bookbinding process by stacking punched sheets on the stacking portion so that the binding member arranged in the stacking portion penetrates punch holes into the punched sheets, and bending the binding member that has penetrated the punch holes in a ring shape to bind the punched sheets.

6. A control method for an image forming apparatus, the image forming apparatus comprising: a printer configured to perform print processing on a sheet; a puncher configured to punch the sheet printed by the printer; a binder provided with a stacking portion on which a plurality of sheets punched by the puncher are to be stacked, the binder being configured to perform a bookbinding process so as to form a bound product in which a binding member penetrates punch holes into the plurality of sheets stacked on the stacking portion; and an annunciator configured to notify information, the control method comprising:

a first detection step of detecting a first jam of a sheet in the binder;

a second detection step of detecting a second jam of a sheet which occurs upstream of the binder in a conveyance direction of the sheet; and a control step of causing the annunciator to notify first instruction information for instructing removal of a sheet and the binding member, which are located in the binder and for which the bookbinding process is incomplete, in a case where the first jam has been detected in the first detection step, and causing the annunciator to notify second instruction information for instructing removal of the second jam, in a case where the second jam has been detected in the second detection step and the first jam has not been detected in the first detection step.

7. A non-transitory computer-readable storage medium, which stores a program which causes a computer to execute a control method for an image forming apparatus, the image forming apparatus comprising: a printer configured to perform print processing on a sheet; a puncher configured to punch the sheet printed by the printer; a binder provided with a stacking portion on which a plurality of sheets punched by the puncher are to be stacked, the binder being configured to perform a bookbinding process so as to form a bound product in which a binding member penetrates punch holes into the plurality of sheets stacked on the stacking portion; and an annunciator configured to notify information, the control method comprising:

a first detection step of detecting a first jam of a sheet in the binder;

a second detection step of detecting a second jam of a sheet which occurs upstream of the binder in a conveyance direction of the sheet; and a control step of causing the annunciator to notify first instruction information for instructing removal of a sheet and the binding member, which are located in the binder and for which the bookbinding process is incomplete, in a case where the first jam has been detected in the first detection step, and causing the annunciator to notify second instruction information for instructing removal of the second jam in a case where the second jam has been detected in the second detection step and the first jam has not been detected in the first detection step.

* * * * *